US008544837B2

(12) United States Patent
Yap et al.

(10) Patent No.: US 8,544,837 B2
(45) Date of Patent: Oct. 1, 2013

(54) VACUUM ROLLER ASSEMBLY

(75) Inventors: Anthony E. Yap, Danbury, CT (US); Thomas M. Lyga, Southbury, CT (US); Mark MacLeod, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 13/341,673

(22) Filed: Dec. 30, 2011

(65) Prior Publication Data

US 2013/0168918 A1 Jul. 4, 2013

(51) Int. Cl.
*B65H 3/08* (2006.01)

(52) U.S. Cl.
USPC ..... 271/90

(58) Field of Classification Search
USPC ..... 271/11, 20, 23, 90, 94, 99, 104, 106, 271/112, 132, 96, 275, 276; 226/95; 101/389.1; 492/16–20, 22, 24–26, 32, 48, 492/368, 369, 370, 371; 400/629, 641
See application file for complete search history.

(56) References Cited

U.S. PATENT DOCUMENTS

| | | | | |
|---|---|---|---|---|
| 3,025,052 | A * | 3/1962 | Gutteling | 271/94 |
| 3,942,788 | A * | 3/1976 | Boyle | 271/250 |
| 4,858,422 | A * | 8/1989 | Stahlecker | 57/401 |
| 5,213,320 | A * | 5/1993 | Hirota et al. | 271/11 |
| 6,189,883 | B1 * | 2/2001 | Wright et al. | 271/96 |
| 7,552,919 | B2 * | 6/2009 | Lisena | 271/90 |

* cited by examiner

*Primary Examiner* — Thomas Morrison
(74) *Attorney, Agent, or Firm* — Steven J. Shapiro; Charles R. Malandra, Jr.

(57) ABSTRACT

A vacuum roller assembly adapted to singulate a sheet from a stack of sheets. The vacuum roller assembly comprising a stationary inner plenum having a substantially linear plenum slot disposed in fluid communication with the vacuum source and a rotating vacuum roller disposed over the stationary inner plenum and rotating about a rotational axis. The vacuum roller includes a plurality of apertures disposed in fluid communication with the substantially linear plenum slot and about the periphery in at least one region of the roller. Furthermore, each of the apertures is substantially slot-shaped and defines a major axis. The major axis is off-axis with respect to the substantially liner plenum slot of the inner plenum to reduce audible noise levels produced by the rotating vacuum roller as air flows through each rotating aperture into the stationary linear plenum slot.

13 Claims, 19 Drawing Sheets

VACUUM ROLLER ASSEMBLY

FIELD OF THE INVENTION

The present invention relates to a system and method for handling sheet material, and more particularly, to a system and method for minimizing the conveyance feed path to reduce the spatial requirements of a sheet handling system.

BACKGROUND OF THE INVENTION

Various apparatus are employed for arranging sheet material in a package suitable for use or sale in commerce. One such apparatus, useful for describing the teachings of the present invention, is a mailpiece inserter system employed in the fabrication of high volume mail communications, e.g., mass mailings. Such mailpiece inserter systems are typically used by organizations such as banks, insurance companies, and utility companies for producing a large volume of specific mail communications where the contents of each mailpiece are directed to a particular addressee. Also, other organizations, such as direct mailers, use mail inserters for producing mass mailings where the contents of each mail piece are substantially identical with respect to each addressee. Examples of inserter systems are the 8 series, 9 series, and APS™ inserter systems available from Pitney Bowes Inc. located in Stamford, Conn., USA.

In many respects, a typical inserter system resembles a manufacturing assembly line. Sheets and other raw materials (i.e., a web of paper stock, enclosures, and envelopes) enter the inserter system as inputs. Various modules or workstations in the inserter system work cooperatively to process the sheets until a finished mail piece is produced. For example, in a mailpiece inserter, an envelope is conveyed downstream to each processing module by a transport or conveyance including drive elements such as rollers or a series of belts. The processing modules may include, inter alia, (i) a web for feeding printed sheet material, i.e., material to be used as the content material for mailpiece creation, (ii) a module for cutting the printed sheet materiai to various lengths, (iii) a feed input assembly for accepting the printed sheet material from the cutting module, (iv) a folding module for folding mailpiece content material for subsequent insertion into the envelope, (v) a chassis module where sheet material and/or inserts, i.e., the content material, are combined to form a collation, (vi) an inserter module which opens an envelope for receipt of the content material, (vii) a moistening/sealing module for wetting the flap sealant to close the envelope, (viii) a weighing module for determining the weight of the mailpiece for postage, and (x) a metering module for printing the postage indicia based upon the weight and/or size of the envelope, i.e., applying evidence of postage on the mailpiece. While these are some of the more commonly used modules for mailpiece creation, it will be appreciated that the particular arrangement and/or need for specialty modules, are dependent upon the needs of the user/customer.

Inasmuch as a mailpiece inserter comprises a plurality of processing modules, it is oftentimes desirable to reduce the conveyance feed path, and, accordingly, the "foot-print" occupied by the inserter. That is, since the real-estate occupied by a mailpiece inserter translates into a "fixed expense" for an operator, it is desirable to reduce the space consumed by the inserter. As a result, savings can be achieved by reducing the length of the conveyance feed path.

Of the many challenges faced by designers of mailpiece inserters, one area which results in a requirement for greater space/length of the conveyance path is the transition between modules. That is, to accommodate sheets of variable length, or process certain mail run jobs, a threshold spacing must be maintained between modules to ensure that a downstream module does not prematurely begin processing/handling a sheet/collation before an upstream module has completed an operation. For example, it is common practice to lengthen the feed path, or include a buffer region between modules, to allow a larger sheet, e.g., 11×17 inch sheet, to be processed/handled by an upstream module without interference by a downstream module.

In the case of a print module, it will be appreciated that a blank sheet is fed past a printhead which prints from a leading to a trailing edge. As the sheet is fed and printed, the leading edge is conveyed downstream or "leads" as the sheet is printed along or near the trailing edge. No operation can be performed on the leading edge (which is now downstream of the printhead) while the trailing edge is being printed. As a consequence, the conveyance feed path will typically include the full length of a sheet before a downstream module can accept and begin another operation.

Another example includes the transition between a cutting module and a feed input assembly of a mailpiece inserter. In this example, the length of content material can vary from a short insert, i.e., approximately four and one-half inches (4½"), to a double-length sheet, i.e., approximately seventeen inches (17"). As a result, the feed path between the cutting module and the feed input assembly can vary by more than twelve inches (12") or one foot (1'). Stated in yet other terms, the point of entry/ingestion of the leading edge of a long sheet can lengthen the feed path of the inserter as compared to the entry point required by a short insert, e.g., the location of a nip for ingesting the leading edge of the insert.

Finally, the initial set-up and anticipated processing of a sheet/collation can adversely impact the length of the conveyance feed path. For example, it is common practice to include a symbol/mark/scan code on one or more sheets of a collation to provide information concerning the processing of the collation. When accumulating a collation of sheets, a scanner disposed upstream of the accumulator, reads the symbol/mark/scan code so that the inserter may know when a collation begins or ends. That is, the mailpiece processor interprets the symbol/mark/scan code such that it may determine which sheet, of the stream of sheets being fed along a conveyance path, is the first sheet of the next collation.

As a result, information is obtained concerning when the Beginning Of the next Collation (BOC) begins and/or when the end of the current collation ends. Depending upon the location of this symbol/mark/scan code, the length of the conveyance feed path (between an upstream singulating module, i.e., a module which singulates/feeds sheets, and a downstream accumulator), must accommodate the longest sheet anticipated to be processed. If, for example, the symbol/mark/scan code is located along a trailing edge of a sheet to be processed, then the length of the conveyance path must be at least as long as the distance between the leading edge of the sheet and the BOC plus a threshold pitch distance (i.e., the distance between the trailing edge of one sheet and the leading edge of the subsequent sheet as determined by the throughput requirements/speed of the mailpiece inserter).

In each of the above examples, it will be appreciated that conveyance systems of the prior art are constrained by a requirement to accommodate processing of the largest sheet, whether dictated by the length dimension of the sheet, or the location/position of a symbol/mark/scan code on the face of the sheet. As a result, the overall foot-print/size of the sheet handling system, e.g., a mailpiece inserter, is increased by the limitation to maintain a minimum spacing, or threshold distance, between modules.

Yet another challenge for designers of mailpiece creation systems relates to the audible noise levels produced by the sheet feed mechanisms upstream of the accumulator assembly. To the extent that such sheet feed apparatus employ vacuum feed devices, the audible noise levels produced by rotating vacuum rollers can create significant discomfort for operators of the mailpiece creation system. Generally, such devices can have the fluid flow characteristics and, respective, sound levels of a conventional rotating siren/horn.

A need, therefore, exists for an apparatus for reliably singulating sheet material sheets without the operator discomfort and other limitations of prior art sheet handling systems.

SUMMARY OF THE INVENTION

A vacuum roller assembly is adapted for use in combination with a vacuum source to develop a pressure differential along the surface of the roller assembly to singulate a sheet from a stack of sheets. The vacuum roller assembly comprising a stationary inner plenum having a substantially linear plenum slot disposed in fluid communication with the vacuum source and a rotating vacuum roller disposed over the stationary inner plenum and rotating about a rotational axis. The vacuum roller includes a plurality of apertures disposed in fluid communication with the substantially linear plenum slot and about the periphery in at least one region of the roller. Furthermore, each of the apertures is substantially slot-shaped and defines a major axis. The major axis is off-axis with respect to the substantially liner plenum slot of the inner plenum to reduce audible noise levels produced by the rotating vacuum roller as air flows through each rotating aperture into the stationary linear plenum slot.

BRIEF DESCRIPTION OF THE DRAWINGS

Further details of the present invention are provided in the accompanying drawings, detailed description, and claims.

DETAILED DESCRIPTION

The invention described herein is directed to an improved sheet handling system. Firstly, the invention describes a feed apparatus having an improved vacuum roller which reliably singulates sheet material for delivery to the accumulator while reducing the audible noise levels generated by the vacuum pump for increased operator comfort. Additionally, the invention describes an improved sheet material accumulator including an auxiliary conveyance which accumulator improves throughput by selectively operating one of at least two operating modes Finally, a method of operating a sheet handling system is described to reduce the conveyance feed path and decrease the overall envelope/foot-print occupied by the sheet handling system.

The system, apparatus and method of the present invention will be discussed in the context of a mailpiece inserter including a feed module disposed upstream of a sheet accumulating module, although, the teachings described herein are equally applicable to other sheet handling equipment and systems. Consequently, the described embodiment is merely an exemplary arrangement of the present invention and the appended claims should be broadly interpreted in view thereof.

Figure 1:
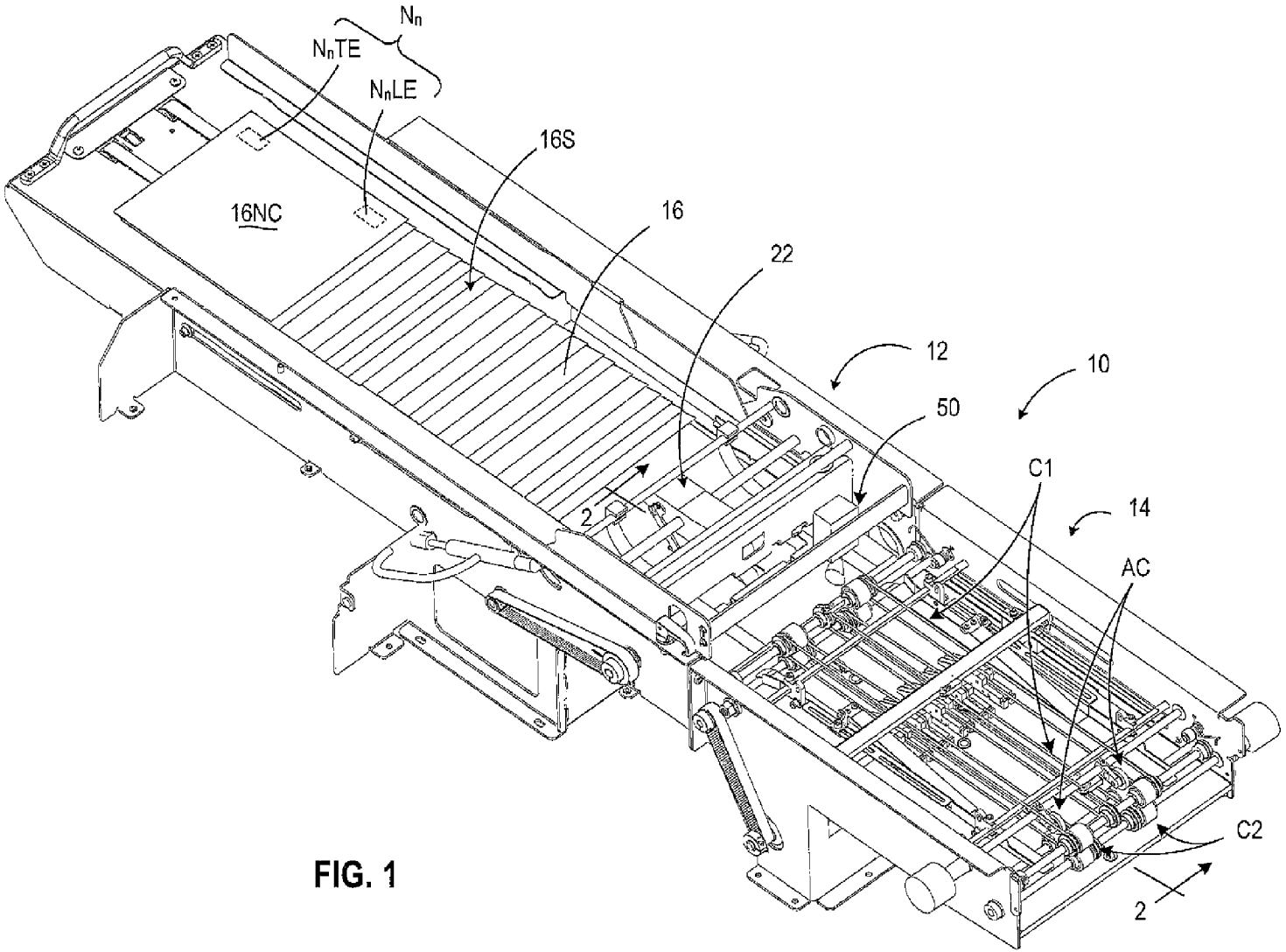
FIG. 1 is a broken-away perspective view of the relevant portions of a sheet handling system, e.g., a mailpiece inserter, including a feed module in combination with an accumulator module operative to accumulate/stack sheets to produce a collation of sheets.
Figure 2:
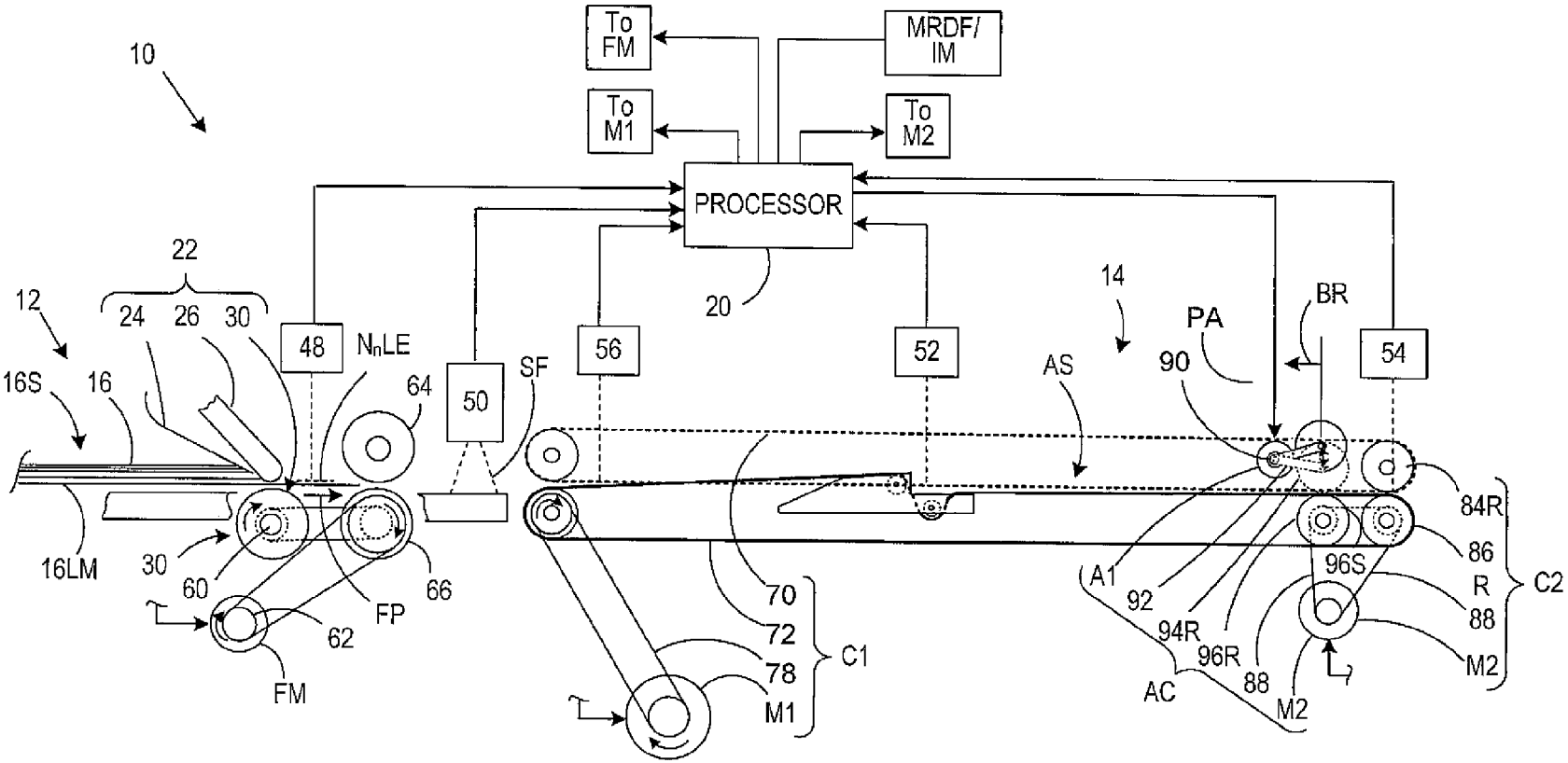
FIG. 2 depicts a broken-away schematic view of the mailpiece inserter taken substantially along line 2-2 of FIG. 1 wherein the accumulator module includes a first conveyance, a second conveyance, and an auxiliary conveyance interposing the first and second conveyances to augment dispensation of a completed collation from an accumulation station when the first conveyance is inoperative.

In FIGS. 1 and 2, the relevant portions of a mailpiece inserter 10 are depicted including a feed input/singulation module 12 and sheet accumulation module 14. More specifically, the feed input/singulation module 12 is adapted to accept a shingled stack of sheets 16S comprising the content material for a plurality of mailpieces (not shown). For example, the shingled stack of sheets 16S may comprise pre-printed monthly statements for a credit card company or financial institution. Typically, the statements include one or more pre-printed sheets, i.e., a transmittal page, one or more pages of the transaction activity, and a presentment page for return payment by a customer. Inasmuch as the pre-printed stack 16S typically includes several pages for the creation of each mailpiece, the stack 16S must be singulated and collated for insertion into a mailpiece envelope (also not shown).

A processor or controller 20 (see FIG. 2) is operative to receive inputs from various sensors and/or data files for controlling the requisite operations to process the sheet material 16. While the processor 20 receives input from a variety of modules to create a mailpiece, it should be appreciated that the present invention will describe only those inputs relevant to the feed input and sheet accumulation modules 12, 14.

Feed Input/Simulating Module

Figure 2A:
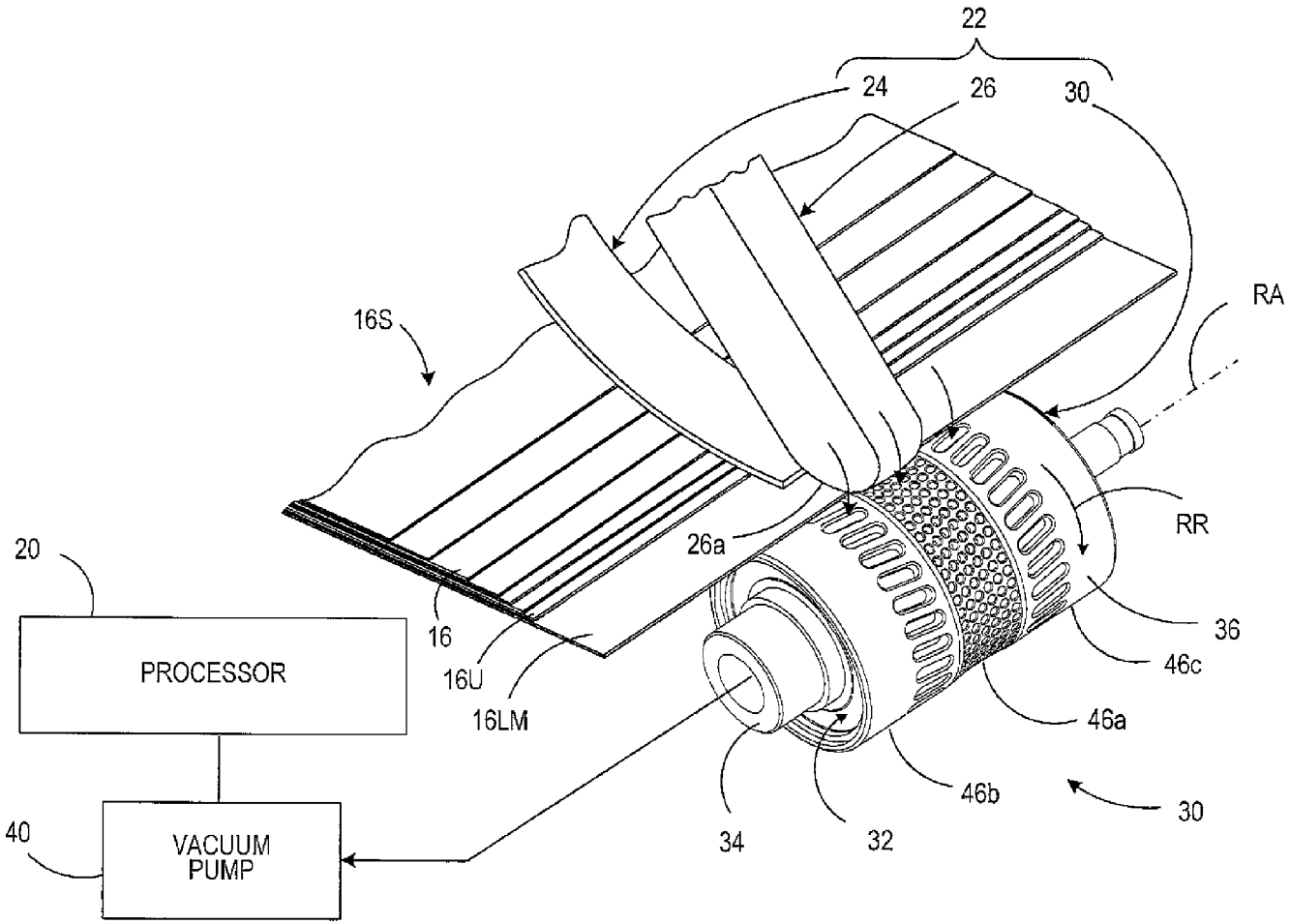
FIG. 2*a* is an isolated perspective view of a vacuum roller assembly according to the present invention for a singulating apparatus which improves the reliability of sheet feeding while minimizing audible noise levels for improved workstation comfort.
Figure 2B:
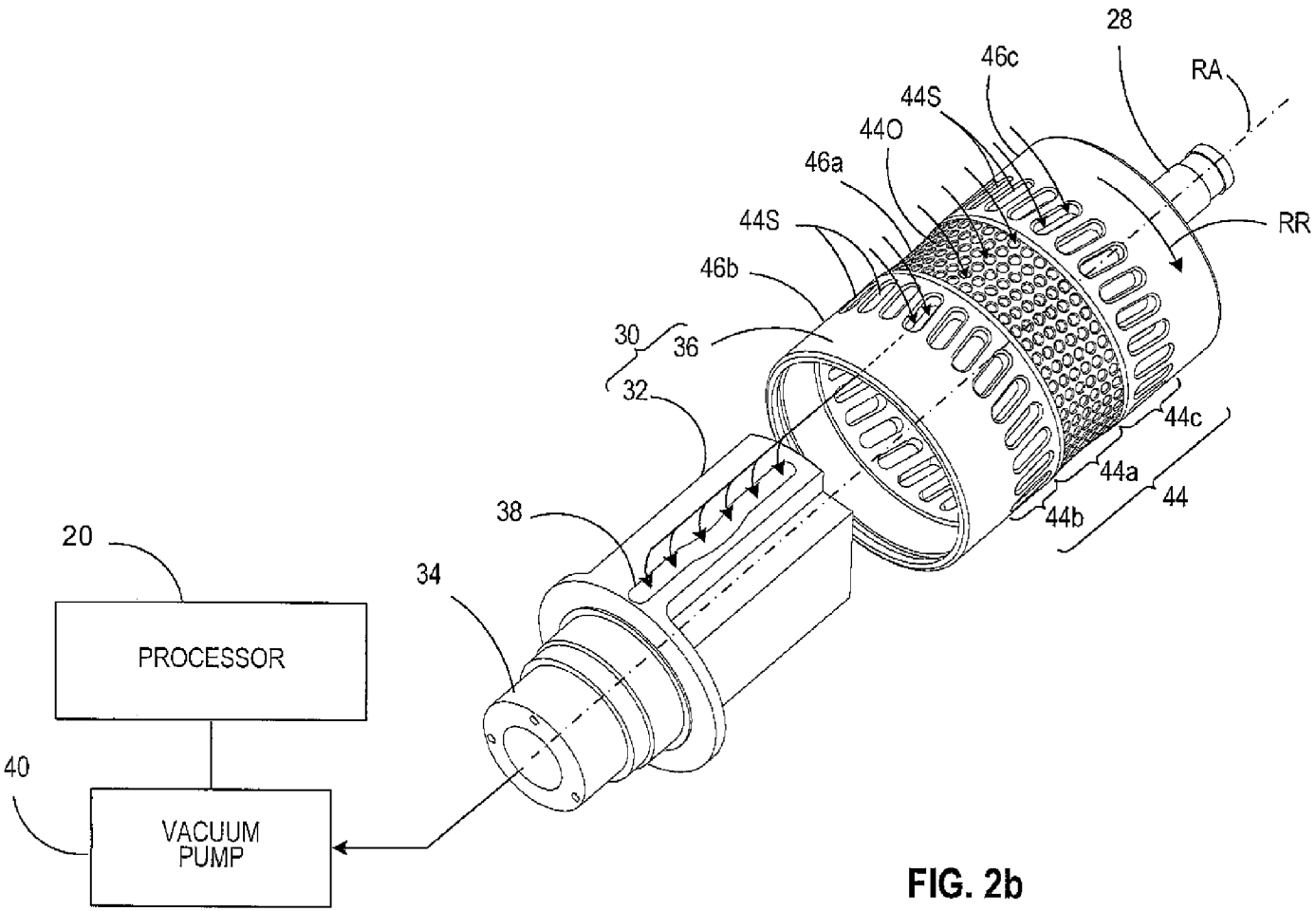
FIG. 2*b* is an exploded view of the vacuum roller assembly depicted in FIG. 2*a* including an external roller having a plurality of off-axis apertures disposed through the roller and a internal plenum in fluid communication with a vacuum pump at one end and with the roller apertures the other end.
Figure 2C:
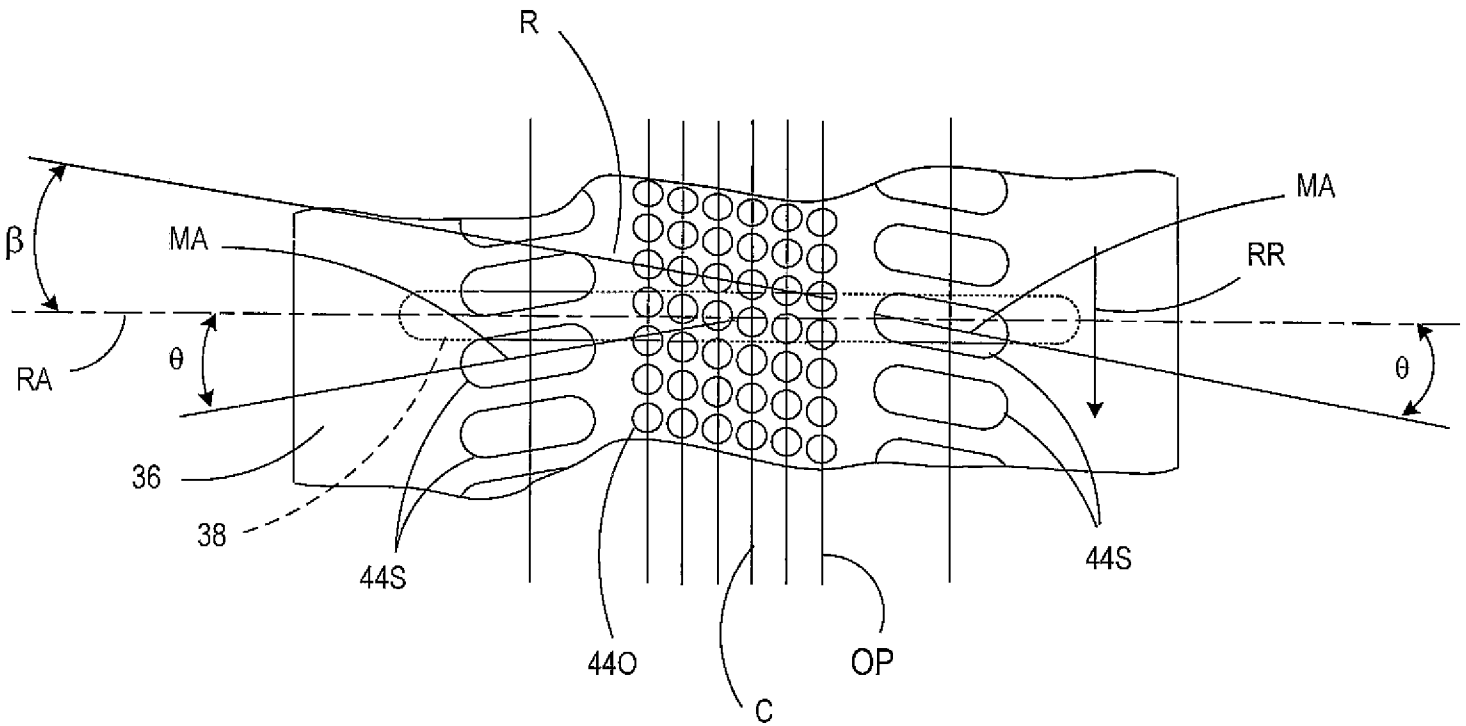
FIG. 2*c* is a broken-away front view of the vacuum roller illustrating the orientation of the off-axis apertures as a two-dimensional flat-pattern.

In FIGS. 1-2*c*, the feed input/singulation module 12 includes a singulating assembly 22 disposed along the feed path operative to strip a single sheet of content material from the shingled stack 16S. The singulating assembly 22 includes a separating guide 24, a stationary roller/finger 26 and a vacuum roller assembly 30. The separating guide 24 retards the motion of the upper sheets of the stack 16S as the lowermost sheets are conveyed/drawn toward the vacuum roller assembly 30. The stationary roller/finger 26 is disposed immediately downstream of the guide 24 and cooperates with the vacuum roller assembly 30 to strip/singulate the lowermost sheet 16LM.

In the described embodiment, and referring to FIGS. 2*a* and 2*b*, the vacuum roller assembly 30 includes an inner plenum 32 which is held stationary by a hollow central shaft 34 and an outer vacuum roller 36 which rotates relative to the inner plenum 32 in the direction of arrow RR by a drive element (not shown).

The stationary inner plenum 32 defines a longitudinal plenum slot 38 (see FIG. 2*b*) which is in fluid communication with a vacuum pump 40 operative to draw air from the slot 38. In the described embodiment, the longitudinal plenum slot 38 defines an elongate opening which is substantially perpendicular to the feed path of the shingled sheet material 16S and is disposed upwardly, i.e., toward the underside of lowermost sheet 16LM.

The outer vacuum roller 36 is disposed over the inner plenum 32 and includes a plurality of apertures 44 which are in fluid communication with the plenum slot 38 for the purpose of producing a negative pressure differential, i.e., a singulating vacuum, along the surface of the roller assembly 30. More specifically, the apertures 44 are arranged in three distinct regions of the vacuum roller 30 to facilitate the directed passage of air while maintaining low audible noise levels for operator comfort.

In the described embodiment, the rotating vacuum roller 36 includes a central region 44*a* having circular-shaped apertures 44O and outboard regions 44*b*, 44*c* having substantially slot-shaped apertures 44S to either side of the central region 44*a*. With respect to the central region 44*a*, the circular apertures 44O are aligned in a plurality of cross-sectional planes which are orthogonal to the rotational axis RA of the vacuum roller 36. Furthermore, the apertures 44O within each plane are staggered, or rotated several degrees in a helical pattern about the axis RA. Furthermore, the central region 44*a* defines a concave surface 46*a* about the circumference of the vacuum roller 36 to facilitate singulation of sheet material 16S. The import of these geometric features will be described in greater detail when discussing the operation of the vacuum roller assembly 30.

With respect to the outboard regions 44*b*, 44*c*, the slot-shaped apertures 44S are similarly aligned, i.e., the geometric center GC of each are aligned relative to an orthogonal plane, however, the orientation of each slot-shaped aperture is off-axis relative to the rotational axis RA of the vacuum roller 36. In the context used herein, "aligned" means that the locus of points defined by the geometric center GC of each aperture 44O lies within a plane orthogonal to the rotational axis RA. Furthermore, in the context used herein, "off-axis" means that the elongate or major axis of each aperture 44S defines an acute angle θ relative to the rotational axis RA. Finally, the external surface or periphery of the vacuum roller 36 in each of the outboard regions 44*b*, 44*c* is substantially cylindrical to facilitate initial separation of the lowermost sheet 16LM from the stack 16S of sheet material. The import of these geometric features will be also discussed when describing the operation of the vacuum roller assembly 30.

The geometry of the vacuum roller 36 may be best understood by referring to a two-dimensional flat pattern perspective thereof depicted in FIG. 2*c*. Therein, the apertures 44O define a plurality of vertical columns C and helical rows R. The vertical columns correspond to each of the orthogonal planes OP while each row extends along the length of the roller in a helical pattern. Therein, six (6) columns are defined which are "staggered" or "off-set" such that a row R slopes downwardly at an acute angle β relative to the rotational axis RA. Furthermore, each of the apertures 44S associated with the outboard regions 44*b*, 44*c*, defines a major axis MA which is off-axis with respect to the rotational axis RA of the vacuum roller 36. The slope of an aperture 44S associated with one of the outboard regions 44*b* is negative (i.e., slopes downwardly from an outboard edge of the roller to the central region 44*a*) while the slope associated with the other of the outboard regions 44*c* is positive (i.e., slopes upwardly to an outboard edge of the roller from the central region 44*a*). In the preferred description, the major axis MA of each aperture 448 defines an angle θ between about five (5) to ten (10) degrees relative to the rotational axis RA.

As mentioned earlier, the geometry and arrangement of apertures 44 of the vacuum roller 36 serves to reliably singulate sheet material 16S while reducing audible noise levels produced by the flow of air when drawing a pressure differential/vacuum across the sheets 16S. These features are best understood by discussing the operation of the vacuum roller assembly 30.

Operationally, the outer vacuum roller 36 rotates over the inner plenum 32 such that the apertures 44O, 44S rotate over the elongate slot 38. As the sheet material 16S is fed to the vacuum roller assembly 30, a negative pressure differential develops along the surface of the vacuum roller 36. More specifically, a pressure differential is first developed in the outboard regions 44*b*, 44*c* to draw the lowermost sheet 16LM from the shingled stack 16S. Inasmuch as the cylindrical external surface of the outboard regions 44*b*, 44*c* compliments the planar contour of the sheet material 16S, the outboard regions 44*b*, 44*c* and the slot-shaped apertures 44S, are principally responsible for drawing the lowermost sheets 16LM from the stack 16S. Inasmuch as frictional forces are developed between the sheets 16, the upper sheets 16U follow the lowermost sheet 16LM, but are shingled when engaging the separating guide 24.

As the sheets 16LM is singulated/drawn from the stack 16S, the stationary roller/finger 26 guides the lowermost sheet 16LM into the concave curvature 46 of the central region 44*a*. More specifically, the stationary roller/finger 26 includes a convex guide surface 26*a* which opposes and compliments the concave surface 46*a* of the vacuum roller 36. As the sheet 16LM follows the contour of the convex guide surface 26*a*, additional vacuum pressure is applied across the sheet 16LM, in the area immediately opposing the concave surface 46*a* of the roller 36. As the lowermost sheet 16LM is drawn into the concave surface 46*a* of vacuum roller 36, it is also drawn away from a sheet 16U immediately adjacent to and above the lowermost sheet. Accordingly, frictional forces developed between the lowermost and upper sheets 16LM, 16U are reduced in this region, i.e., in the region immediately above the concave surface 46*a*. Inasmuch as the friction forces are reduced while the vacuum forces are increased, the lowermost sheet is reliably singulated from the stack 16S. It will be appreciated, therefore, that the vacuum roller 36 of the present reliably singulates the lowermost sheet 16LM without a "miss-feed", i.e., without feeding a sheet from the stack 16S, or "double-feeds", i.e., two or more sheets being fed from the stack.

In addition to enhanced reliability, audible noise levels are reduced by the angular orientation of the slot-shaped apertures 44S. More specifically, the inventors of the present invention discovered that a conventional arrangement of large apertures, i.e., three uniformly-spaced openings along the length of the vacuum roller assembly, produced audible noise levels which were highly uncomfortable to an operator. Upon further study and examination, it was determined that elongate openings provided a degree of relief, however, the level of audible noise continued to be problematic. Finally, it was discovered that the noise levels could be reduced by orienting the apertures 44O, 44S such that airflow was not abruptly ingested by the longitudinal slot 38 of the inner plenum 32. To achieve this effect, the apertures 44O in the central region 44*a* are staggered or off-set such that, at any time, a full compliment cannot flow through all of the apertures 44O at the same time. That is, the apertures 44O are arranged in a helical pattern, i.e., slope downwardly or upwardly, at an acute angle β relative to the rotational axis RA. Similarly, the slot-shaped apertures 44S associated with the outboard regions 44*b*, 44*c* are disposed at an acute angle (i.e., cut across the longitudinal slot 38 of the inner plenum) such that a full compliment of air cannot flow through any one slot-shaped aperture 44S. It was also discovered that the acute angle must within a relatively narrow range, i.e., less than ten (10) degrees, to prevent the loss of air or suction and greater than five (5) degrees to mitigate noise levels.

As sheets are singulated by the feed module 12, they are conveyed in series along a conveyance path FP and dispensed downstream toward the accumulator module 14. In the described embodiment, a sheet feed sensor 48 is disposed downstream of the singulating assembly 22 to sense whether each sheet has been successfully singulated and fed by the feed module 12. More specifically, the sheet feed sensor 48 senses the leading edge of each sheet and provides a signal to the processor 20 for determining whether a miss-feed has occurred. In the event of a miss-feed, the processor 20 may discontinues sheet feed operations or provide a cue to an operator.

Accumulator Module

Figure 3:
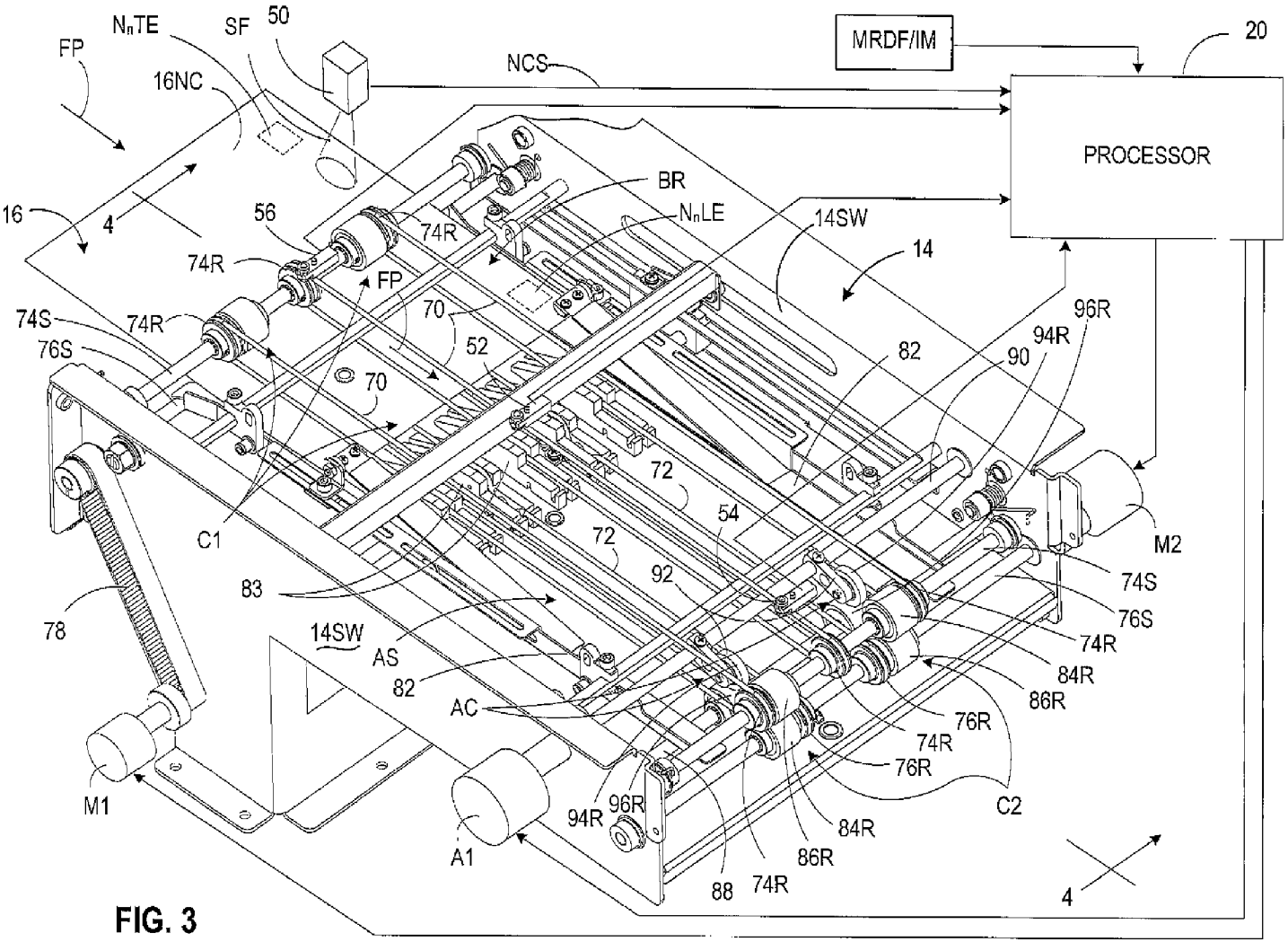
FIG. 3 is an enlarged isolated perspective view of the accumulator module shown in FIG. 1 showing the first, second and auxiliary conveyances in greater detail.

In FIGS. 1, 2 and 3, the accumulator module 14 is disposed downstream of the sheet feed module 12 and is operative to (i) receive pre-printed singulated sheets 16, (ii) stack the sheets into a collation, and (iii) dispense a completed collation to a downstream module for insertion into a mailpiece envelope. Consequently, while the feed module 12 singulates sheets 16 from a shingled stack of sheets 16S, the accumulator 14 re-stacks the sheets into collations, each associated with a particular mail recipient.

Information concerning processing of the singulated sheets 16 may be obtained by one or more optical scanners 50 operative to read scan codes/symbols disposed on the singulated sheets (generally within the margins thereof), directly from the mail run data file MRDF, or from other upstream or downstream modules IM of the mailpiece inserter 10. Additionally, optical position detectors 48, 52, 54, 56 may be employed to determine the instantaneous location of a sheet 16 as the leading or trailing edge of a sheet passes one of the detectors 48, 52, 54, 56, Furthermore, it should be appreciated that a number of rotary encoders (not shown) are disposed on at least one shaft of each of the conveyance rollers, (e.g., the drive shaft 60 of the vacuum roller assembly 30, the drive shaft 60 of the feed motor FM which drives the exit rollers 64, 66 of the feed module 12, etc.). This information is fed to the processor 20 such that, inter alia, the location of each sheet 16 along the feed path FP can be determined at nearly any point along the conveyance feed path FP.

With respect to the accumulator module 14, an important source of information is the Beginning- or End-Of-Collation symbol or mark $N_n$ disposed on select sheets, i.e., a next collation sheet 16NC (see FIGS. 1 and 3), in the series being fed to the accumulator module 14. A Beginning-Of-Collation (BOC) mark denotes which sheet in the series of consecutive sheets is the "first sheet of the next collation". An End-Of-Collation (EOC) mark denotes which sheet in the series of consecutive sheets is the "last sheet of the current collation". Notwithstanding how the BOC/EOC marks $N_n$ are arranged in the stack of sheets for particular mail run job, a scanner 50, upstream of the accumulator module 14 reads the marks $N_n$ on select sheets 16 to determine which sheets are associated with a current collation and which sheets are associated with a next collation.

In one operating mode, a BOC/EOC mark $N_n$LE is located proximal to the leading edge of the next collation sheet 16NC, and in a second operating mode, a BOC/EOC symbol $N_n$TE is located proximal to the trailing edge of the next collation sheet 16NC. The general position of the BOC/EOC mark, i.e., near the leading or trailing edges, may be input by an operator assist processing of the mark. Alternatively, the optical sensors 52, 54, 56 may be used in conjunction with the rotary encoders of the conveyance system, to locate the mark $N_n$LE, $N_n$TE on each of the select sheets 16.

In the described embodiment, the scanner 50 searches for the location of, the mark $N_n$LE, $N_n$TE from signals acquired by the leading edge sensor 48, upstream of the scanner 50. The scanner 50 issues a next collation signal NCS to the processor 20 to determine which sheet, in a series of consecutively fed sheets, is the first sheet of the next collation, or the last sheet of the current collation.

Figure 4:
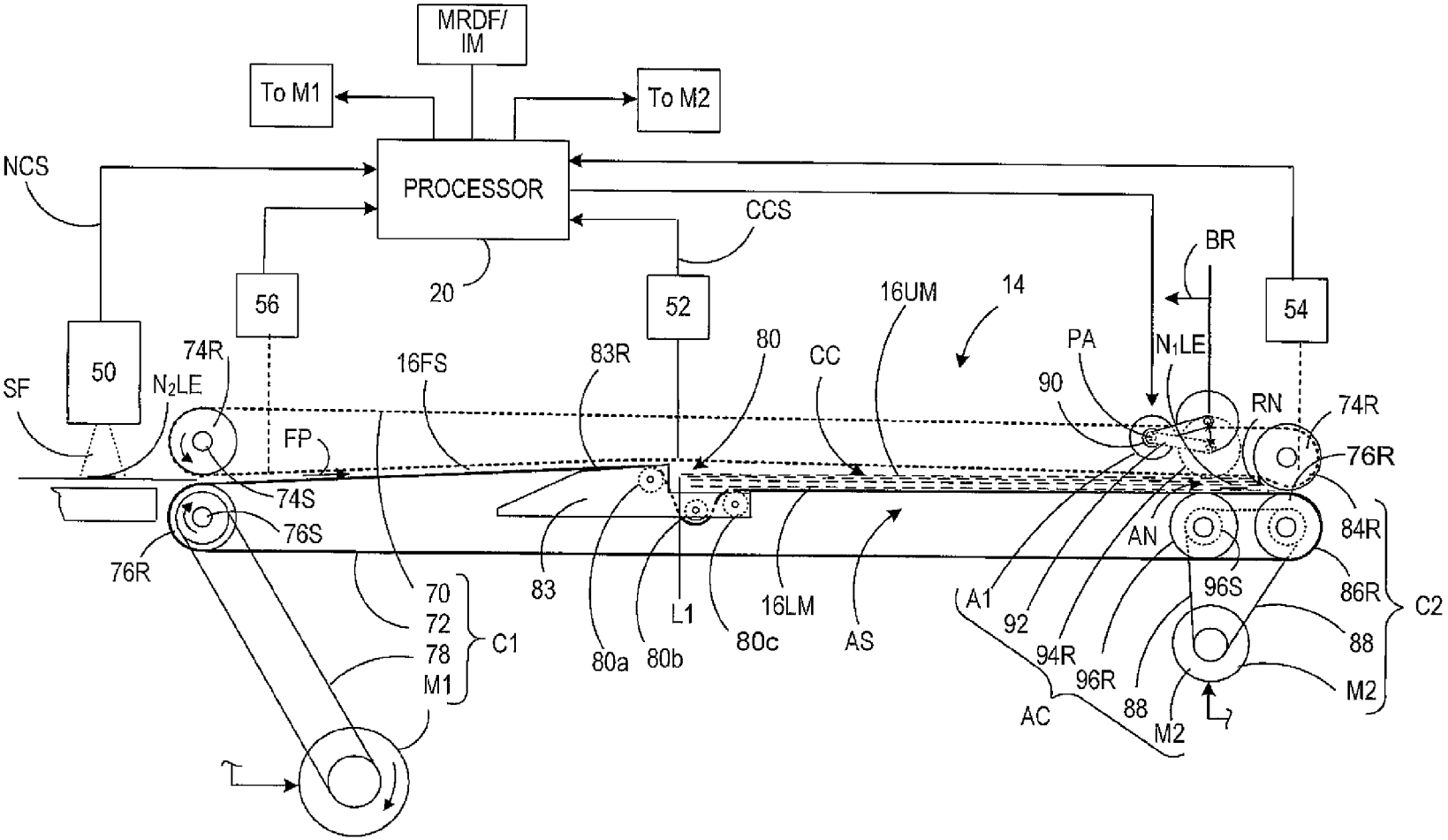
FIG. 4 depicts an enlarged side sectional view of the accumulator module taken substantially along line 4-4 of FIG. 3 including a scanner for detecting a Beginning of Collation/End of Collation (BOC/EOC) mark, on selected sheets and a plurality of sensors indicative of the location, or relative position, of sheets conveyed along the conveyance feed path.

In the broadest sense of the invention and referring to FIGS. 2, 3, and 4 the accumulator 14 according to the present invention includes: (i) a first conveyance C1 for receiving singulated sheets 16 and conveying the sheets 16 to an accumulator station AS to produce completed collations CC (shown in phantom lines in FIG. 4), (ii) a second conveyance C2 for receiving completed collations from the first conveyance C1, in a first operating mode, and dispensing the completed collations from the accumulator station AS, (iii) an auxiliary conveyance AC operative to convey completed collations CC to the second conveyance C2, in a second operating mode, when the first conveyance C1 is inoperative, and (iv) a processor 20, responsive to the next collation signal NCS (FIGS. 3 and 4) to operate the conveyances C1, C2, and AC, based upon a selected one of the operating modes.

More specifically, the processor 20 controls the conveyances C1, C2, AC such that in the second operating mode, the first conveyance C1 feeds a first sheet of the next collation into a buffer region BR of the accumulator 14, and, the auxiliary conveyance AC feeds the completed collation CC to the second conveyance C2 while the first conveyance C1 is deactivated to hold the first sheet of the next collation in the buffer region BR. As will be discussed in greater detail hereinafter, the buffering of the first sheet of the next collation, minimizes the conveyance feed path between the accumulator and an upstream module of the sheet handling system to reduce the overall size envelope of the accumulator 14.

In FIGS. 3 and 4, the first conveyance C1 is adapted to accept the singulated sheets 16 from the feed module 12 and convey the sheets 16 along a feed path FP to the accumulator station AS of the accumulator 14. The first conveyance C1 includes upper and lower transport elements and a means for driving the transport elements along the feed path FR More specifically, the upper and lower transport elements include a series of continuous O-ring members 70, 72 (best seen in FIG. 3) disposed around upper and lower pulley rollers 74R, 76R. The O-ring members 70, 72 of the upper and lower transport elements capture the sheet material therebetween and frictionally-engage a face surface of the sheet material 16 to transport the sheet material along the feed path. The upper transport element is defined by three (3) upper O-ring elements 70 disposed about the upper pulley rollers 74R and the lower transport is defined by two (2) lower O-ring elements 72 disposed about the lower rollers 76R. Furthermore, the upper pulley rollers 74R are supported by, and rotate with, suspension shafts 74S which are disposed across the accumulator 14. Similarly, the lower pulley rollers 76R are supported by, and rotate with, suspension shafts 76S. Each of the suspension shafts 74S, 76S are rotatably mounted within and supported by side wall structures 14SW of the accumulator 14.

The mechanism for driving the transport elements includes a motor M1, a drive belt 78 for rotationally coupling the motor M1 to a first of the drive/suspension shafts, e.g., the lower suspension shaft 76S, and a gear drive mechanism (not shown) rotationally coupling a second of the drive shafts, e.g., the upper suspension shaft 74S, to the first suspension/drive shaft 76S. With respect to the latter, the gear drive mechanism drives the shafts 74S, 76S at the same speed and in opposite directions such that the O-ring elements 70, 72 are driven from an upstream to a downstream location along the conveyance feed path FP.

Accordingly, sheets are accepted between the upper and lower transport elements, i.e., between the O-ring elements 70, 72 and are conveyed to the accumulator station AS (described in greater detail in subsequent paragraphs) along the feed path FR. The operation of the first conveyance C1 is discussed in greater detail below when discussing the operation of the accumulator and method for minimizing the conveyance feed path of a mailpiece inserter.

The second conveyance C2 is adapted to accept a completed collation CC from the accumulator station AS and dispense a completed collation CC (see FIG. 4) from the accumulator station AS to a downstream module of the mailpiece inserter. Specifically, the second conveyance C2 includes at least one pair of nip rollers 84R, 86R defining a nip RN i.e., a region between the cylindrical surfaces of the rollers 84R, 86R, which accepts a leading edge of a completed collation CC. It should be appreciated that a threshold horizontal force F (see FIG. 4) must be applied to develop sufficient friction between the sheets 16, and/or the sheets 16 and rollers 84R, 86R, to cause the completed collation CC to be driven downstream by the second conveyance C2.

Each of the rollers 84R, 86R of the second conveyance C2 are rotationally coupled by a drive shaft 86S to a drive motor M2. In the described embodiment, the motor M2 is rotationally coupled to the drive shaft 86S by a drive belt 88. Furthermore, the nip rollers 84R, 86R of the second conveyance C2 are co-axially aligned with the rotational axis of the downstream pulley rollers 74R, 76R of the first conveyance C1, however, the nip rollers 84R, 86R may be independently, and differentially, driven relative to the pulley rollers 74R, 76R. For example, the downstream pulley rollers 74R, 76R may rotate while the nip rollers 84R, 86R are motionless. Conversely, the nip rollers 84R, 86R of the second conveyance C2 may be driven while the pulley rollers 74R, 76R of the first conveyance C1 are stopped. Additionally, or alternatively, the nip rollers 84R, 86R of the second conveyance C2 may be driven at a higher/lower rotational speed than the pulley rollers 74R, 76R of the first conveyance C1. With respect to the latter, the first and second conveyances C1, C2 may be operated at different speeds to match the throughput of other modules of the sheet handling system.

In the described embodiment, the accumulator station AS is integrated with the first and second conveyances C1, C2, however, it should be appreciated that the accumulator station AS may be an independent module, i.e., may not share components of the conveyances C1, C2. In the broadest sense of the invention, the accumulator station AS includes a means for stacking a select group of sheets, e.g., a group intended for subsequent insertion into a mailpiece envelope, to produce a collation. In the described embodiment, the accumulator station AS includes (i) a means for changing the plane of one sheet 16 relative to another sheet 16 such that the sheets may be stacked vertically, i.e., one atop the other, (ii) a support deck for collecting the vertically stacked sheets, i.e., sheets which comprise the same collation, and (iii) a device for momentarily retarding the motion of select sheets to produce a completed collation.

In the described embodiment, the means for changing the plane of a sheet 16 is effected by creating a vertical step 80 in the lower transport element 72 of the first conveyance C1. More specifically, the vertical step 80 is produced by changing the path of the lower O-ring members 72 around several guide rollers 80*a*, 80*b*, 80*c*. This same arrangement, i.e., of O-ring members 72 and guide rollers 80*a*, 80*b*, 80*c*, also facilitates the creation of the deck for supporting the completed collation CC. More specifically, the deck is defined by a combination of the lower O-ring members 72 and a pair of guide elements 82. The guide elements 82 are disposed on each side of the O-ring members and in combination with the sidewalls 14SW of the accumulator 14. The O-ring members 72 provide support for a center portion of a completed collation CC while the side guides elements 82 support/guide the lateral edges of a collation CC.

In the described embodiment, the means for changing the plane of a sheet 16 is assisted by a plurality of ramps members 83 having ramp surfaces 83R disposed on each side of an O-ring element 72. The illustrated embodiment depicts ten (10) ramp members 83 which are laterally aligned across the width of the accumulator 14.

To accumulate sheet material, the accumulator 14 retards the motion of each sheet 16 in the accumulator station AS. Apparatus to perform this function may include any of one of a variety of know mechanisms to retain a sheet at a select location along a feed path FP. For example, a simple rotating finger, or group of fingers, may extend vertically upward into the feed path to retard the motion of one sheet while a subsequent sheet is stacked over the current sheet. In the described embodiment, this function is, however, integrated with the nip rollers 84R, 86R of the second conveyance C2. More specifically, selected sheets 16 are retained in the accumulator station AS by fixing the rotational position of the nip rollers 84R, 86R as the first conveyance C1 drives additional sheets 16 into the accumulator station AS. The need to lock the rotational position of the nip rollers 84R, 86R is particularly evident inasmuch as the nip rollers 86R of the second conveyance C2 share the same rotational axis as the pulley rollers 76R of the first conveyance C1, (albeit the shafts are rotationally independent from each other).

The auxiliary conveyance AC is adapted to convey a completed collation CC to the second conveyance C2 by engaging and disengaging the collation based upon the selected operating mode. The auxiliary conveyance AC includes at least one upper idler roller 94R adapted to engage and disengage an uppermost sheet 16UM (see FIG. 4) of the completed collation CC and at least one lower drive roller 96R adapted to drive a lowermost sheet 16LM (see FIG. 4) of the completed collation CC toward the second conveyance C2. The upper idler roller 94R is rotationally mounted to a pivot arm 92 disposed on the upper side of the completed collation CC and is mounted to a rotary actuator A1. In the described embodiment, a pair of idler rollers 94R mount to respective pivot arms 92 which, in turn, mount to a pivot shaft 90 supported by the sidewall structure 14SW of the accumulator 14. The rotary actuator A1 is connected to the shaft 90 such that each of the idler rollers 94R pivots into an out of engagement with the completed collation about a pivot axis PA (see FIG. 4)

In the described embodiment, a pair of lower drive rollers 96R mount to a shaft 96S which rotationally mounts to the sidewall structure 14SW of the accumulator 14. Furthermore, each of the drive rollers 96R is aligned with an upper idler roller 94R such that, when engaged, an auxiliary drive nip AN is created therebetween. Moreover, the same motor M2 and drive belt 88 used to drive the lower nip roller 86R of the second conveyance C2. That is, the mechanisms for driving the lower drive roller 96R of the auxiliary conveyance AC and the lower nip roller 86R of the second conveyance C2 are integrated, or common to both conveyances AC, C2, to reduce the number of component parts and the cost associated therewith. While these drive mechanisms are integrated, it should be appreciated that each roller 86R, 96R may be driven independently, i.e., by separate drive motors and belts. The operation of the auxiliary conveyance AC, is discussed in greater detail in the subsequent paragraphs when discussing the operation of the accumulator.

System and Method for Operating a Sheet Handling System to Minimize the Conveyance Feed Path Thereof The following describes the operation of the accumulator 14 and the method for controlling the sheet handling system, i.e., the mailpiece inserter 10, for minimizing the overall conveyance path required to process sheet material, i.e., prepare the sheet material for insertion into a mailpiece envelope.

Returning briefly to FIGS. 1, 3 and 4, a shingled stack of pre-printed sheet material 16 is fed into the feed module 12 of the mailpiece inserter 10. The pre-printed sheets 16 can have a BOC/EOC mark $N_n$, i.e., a mark $N_n$LE proximal to a leading edge or a mark $N_n$TE proximal to a trailing edge of the next collation sheet 16NC, i.e., the sheet representing the first sheet of the next collation or the last sheet of a current collation CC. Upon being singulated by the feed module 12, each sheet is fed serially along the feed path FP across a scan field SF of the scanner 50. It should be appreciated that the scan field SF may be projected from above or below the sheet material 16 depending upon the location of the BOC/EOC mark $N_n$.

Figure 5A:
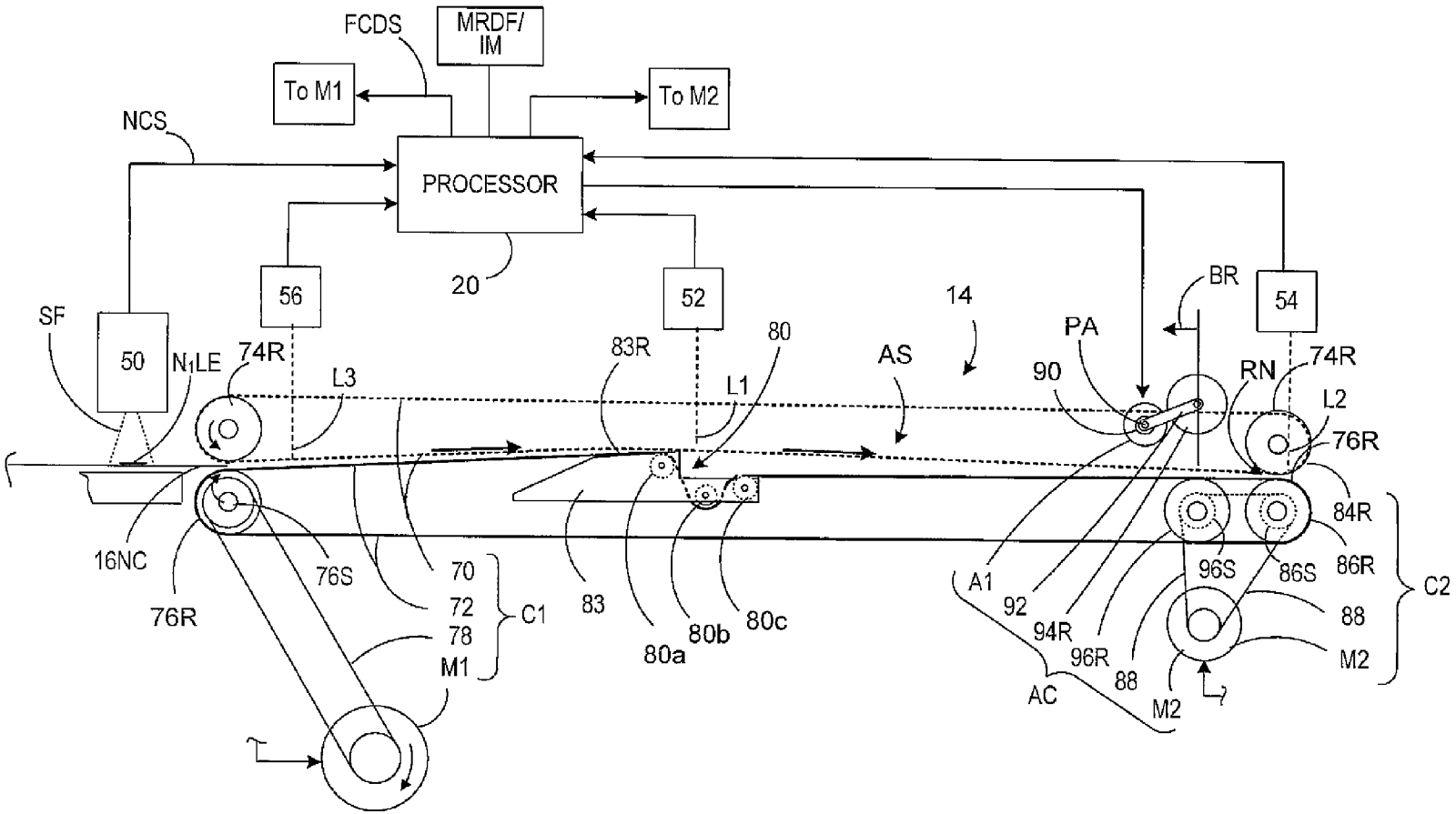
FIGS. 5*a* though 5*e* depict schematic views of the accumulator module, in a first operating mode, wherein a BOC/EOC mark is printed proximal to the leading edge of selected sheets and wherein each of the FIGS. 5*a* through 5*e* depict the operation of the accumulator at a particular moment in an accumulation cycle.

FIGS. 5*a* though 5*e* illustrate the operation of the sheet handling system in a first operating mode, wherein a BOC/EOC mark $N_n$LE has been printed proximal to the leading edge of selected sheets 16. It should be appreciated that the sheet handling system of the present invention is adapted to process sheet material irrespective the location of the BOC/EOC mark $N_n$ while, at the same time, minimizing the length of the conveyance path, i.e., the distance between modules 12, 14. Each of the FIGS. 5*a* through 5*e* depicts a snapshot in time, i.e., as the sheets of the collation are accumulated and/or dispensed from the accumulator 14.

The operation of the sheet handling system described in FIGS. 5*a*-6*g* identify changes in state, however, it should be appreciated that the various sensors and processor operate continuously. Furthermore, it should be understood that when a signal is not issued or identified, it should be assumed that the processor 20, or components controlled by the processor, i.e., the first, second and auxiliary conveyances C1, C2 and AC continue to operate in their previously identified state. Moreover, changes in the state of operation from an active to inactive state may also be synonymous with the absence, or lack of a signal. In view of the foregoing, it may be assumed that each of the conveyances C1, C2 and AC is inoperative in the absence of a control signal.

In FIG. 5*a*, the scanner 50 detects a first Beginning of Collation/End of Collation mark, $N_1$LE on a first sheet 16NC of a current collation. The BOC/FOC mark $N_1$LE has been printed proximal to the leading edge of the first sheet 16NC. Upon receipt of a next collation signal NCS, the processor 20 issues a first conveyance drive signal FDCS to the motor M1 to drive the pulley rollers 74R, 76R and O-ring elements 70, 72 of the of the first conveyance C1. Accordingly, the first sheet 16NC is accepted by the first conveyance C1 of the accumulator 14, i.e., between the O-ring members 70, 72 of the upper and lower transport elements, for transfer to the accumulator station AS.

Figure 5B:
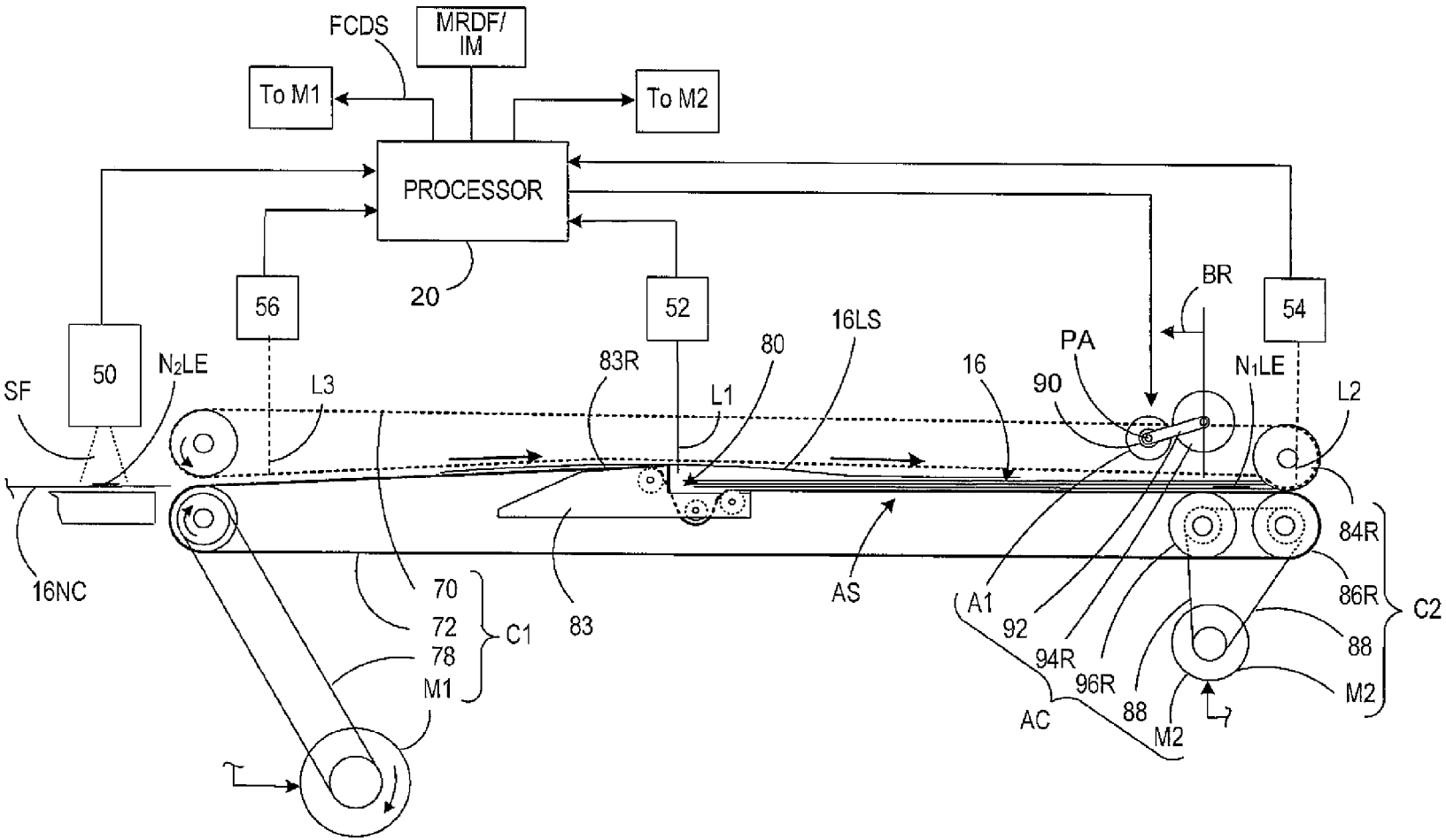

In FIG. 5*b*, the sheets are conveyed by the first conveyance C1 to the accumulator station AS. The leading edge of each sheet 16 is guided upwardly over the ramped surfaces 83R of the ramp elements 83 and allowed to accumulate on the support surface of the accumulator station. As mentioned earlier, the support surface is defined by the O-ring elements 72 of the lower transport element, i.e., the portion downstream of the vertical step 80, in combination with the side guides 82 of the accumulator 14. Upon reaching the accumulator station AS, the motion of each sheet 16 is halted by the nip rollers 84R, 86R of the second conveyance C2 which is inoperative while the sheets 16 are accumulated. That is, the nip spacing of the rollers 84R, 86R is sufficiently close to prevent any of the sheets 16 from passing downstream thereof. As the sheets are accumulated, a second Beginning of Collation/End of Collation mark, $N_2$LE is detected by the scanner 50 on a next collation sheet 16NC. Upon receipt of a next collation signal NCS, the processor 20 tracks the location of the last sheet 16LS of the current collation, i.e., immediately downstream of the next collation sheet 16NC, by the first position sensor 52.

Figure 5C:
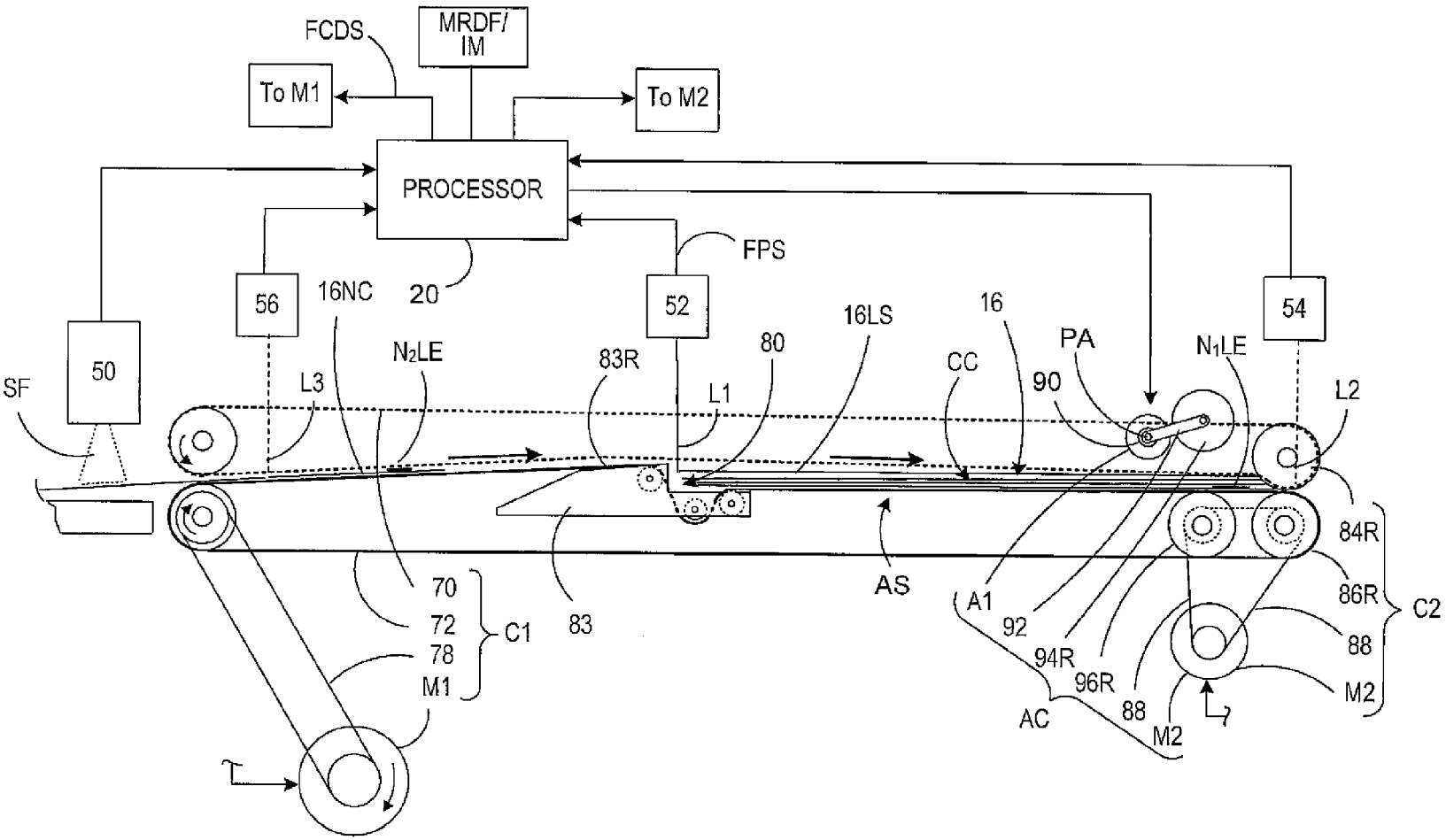

In FIG. 5*c*, the first conveyance C1 continues to drive sheet material 16 to the accumulator station AS, and urge sheet material to the second conveyance C2, i.e., into the nip RN of the second conveyance nip rollers 84R, 86R. Furthermore, the processor 20 determines when the last sheet 16LS of the current collation has passed a first threshold location L1 along the conveyance feed path indicative of a completed collation CC. More specifically, the first position sensor 52 issues a completed collation signal FPS to the processor 20 when the trailing edge of the last sheet 16LS has been accumulated.

Figure 5D:
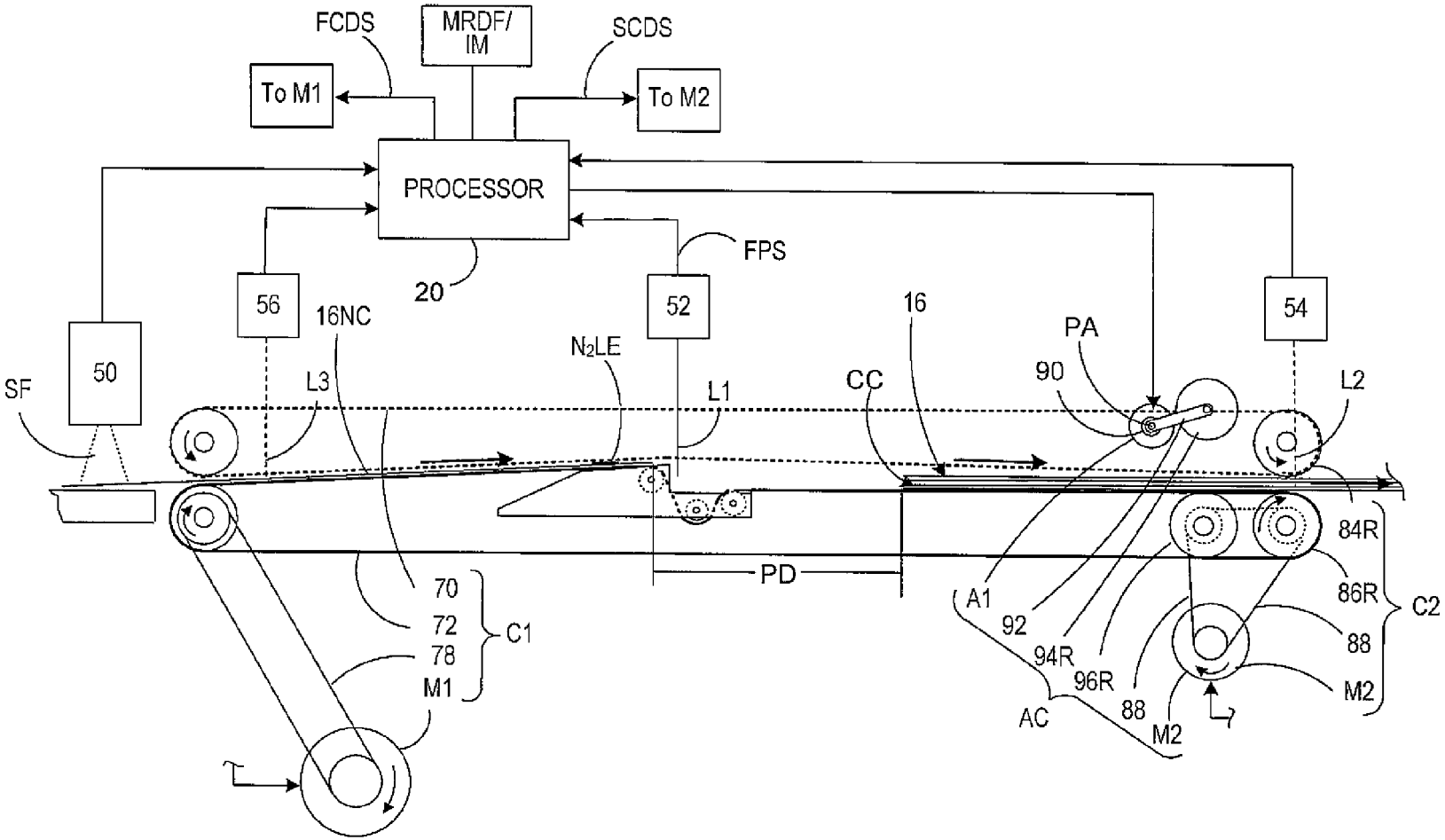

In FIG. 5*d*, the first conveyance C1 urges a completed collation CC to the second conveyance C2. Furthermore, in response to the first position signal FPS, the processor 20 initiates a second conveyance drive signal SDS to the motor M2 of the second conveyance C2. As a consequence, both the first and second conveyances C1, C2 are driven to dispense the completed collation CC from the accumulator station AS. Additionally, the first sheet 16NC of the next collation is driven downstream toward the accumulator station AS such that a pitch distance PD is maintained between the trailing edge of the completed collation CC and the leading edge of the first sheet 16NC.

Figure 5E:
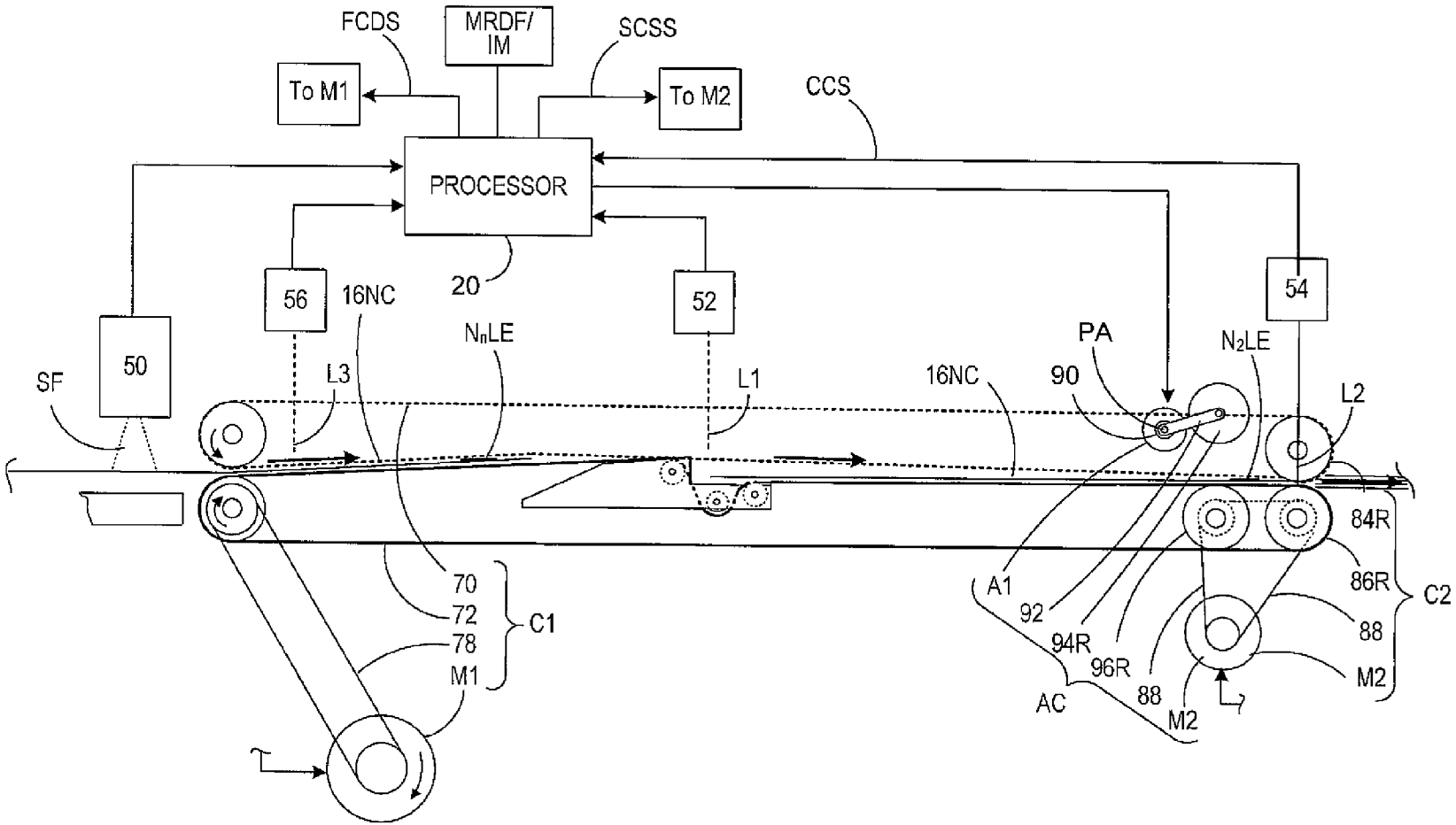

In FIG. 5*e*, the completed collation CC is dispensed from the accumulator station AS to a downstream module. More specifically, the processor 20 determines when the completed collation CC has passed a second threshold location L2 along the conveyance feed path indicative that an accumulation cycle has been completed. More specifically, the second position sensor 54 issues a cycle completed signal CCS to the processor 20 when the collation passes the second threshold location, downstream of the accumulator station AS.

Figure 6A:
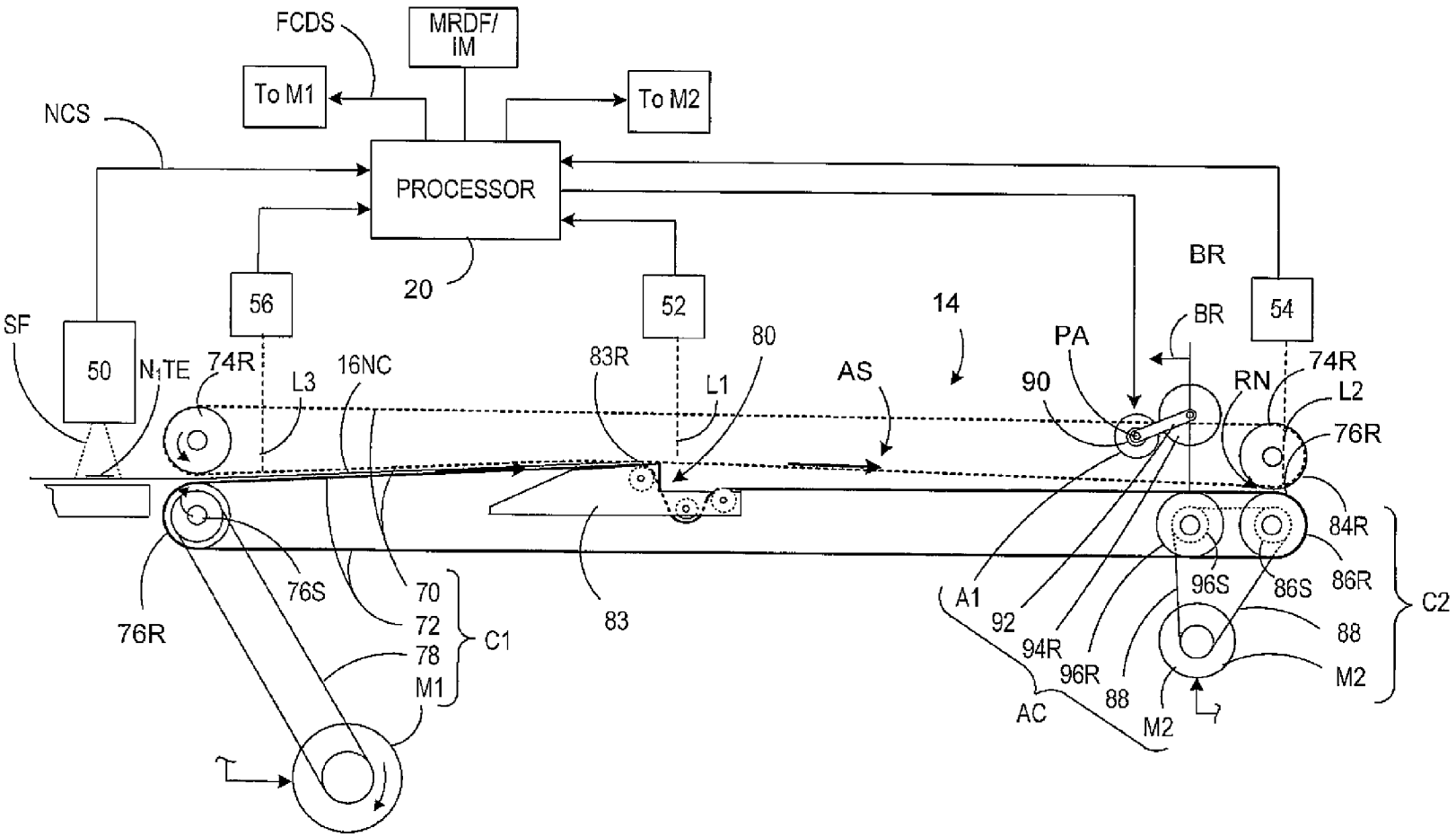
FIGS. 6*a* though 6*g* depict schematic views of the accumulator module, in a second operating mode, wherein a BOC/EOC mark is printed proximal to the leading edge of selected sheets and wherein each of the FIGS. 6*a* through 6*g* depict the operation of the accumulator at a particular moment in an accumulation cycle.

FIGS. 6*a* though 6*g* illustrate the operation of the sheet handling system, in a second operating mode, wherein a BOC/EOC mark has been printed proximal to the trailing edge of selected sheets 16. Each of the FIGS. 6*a* through 6*g* depicts a snapshot in time, i.e., as the sheets of the collation are accumulated, buffered in and/or dispensed from the accumulator 14.

In FIG. 6*a*, the scanner 50 detects a first Beginning of Collation/End of Collation mark, $N_1$TE on a first sheet 16NC of a current collation. The BOC/EOC mark $N_1$TE has been printed proximal to the trailing edge of the first sheet 16NC. Upon receipt of a next collation signal NCS, the processor 20 issues a first conveyance drive signal FDCS to the motor M1 to drive the pulley rollers 74R, 76R and O-ring elements 70, 72 of the of the first conveyance C1. Accordingly, the first sheet 16NC is accepted by the first conveyance C1 of the accumulator 14, i.e., between the O-ring members 70, 72 of the upper and lower transport elements, for transfer to the accumulator station AS.

Figure 6B:
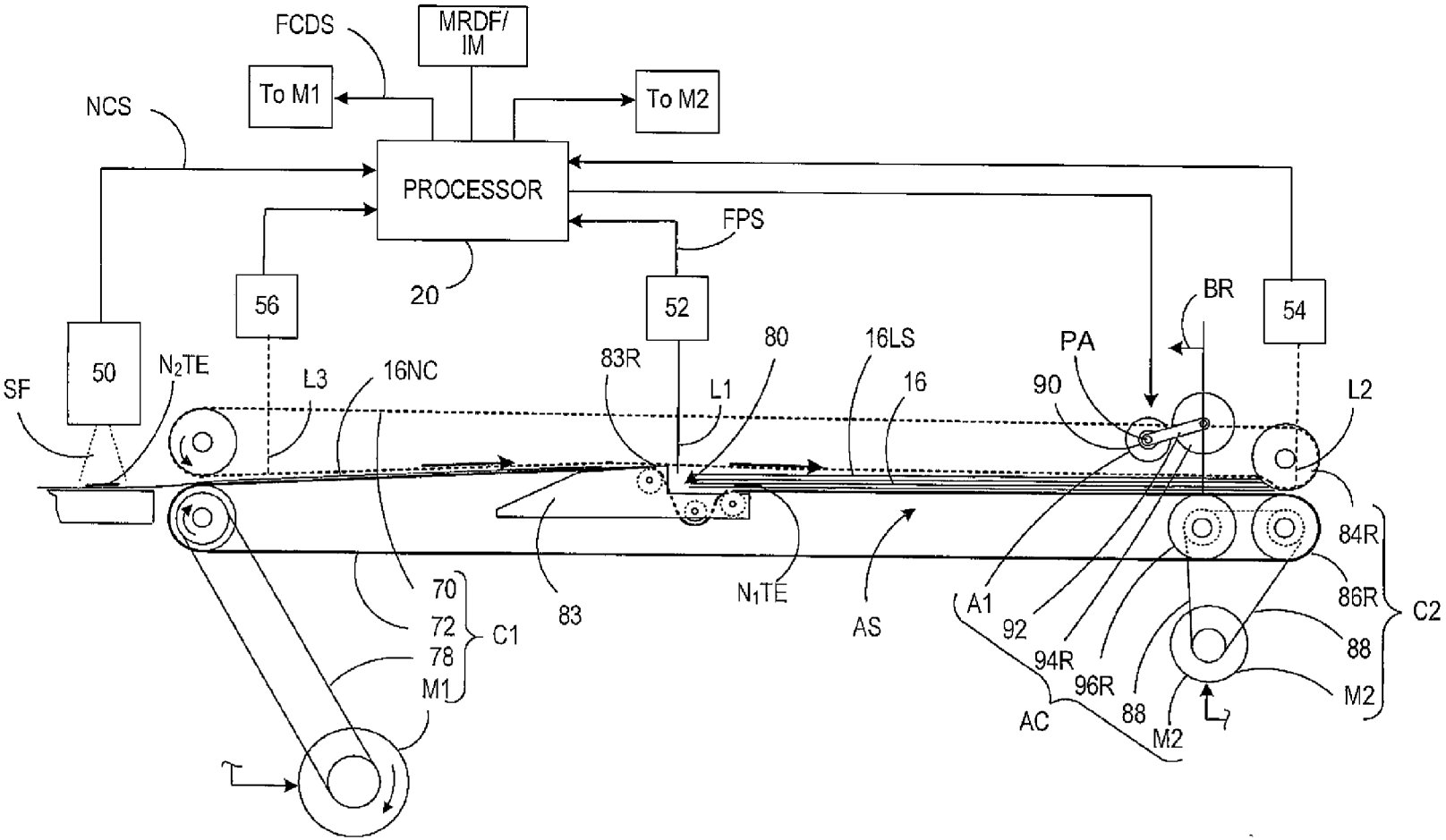

In FIG. 6*b*, the sheets 16 are conveyed by the first conveyance C1 to the accumulator station AS. The leading edge of each sheet 16 is guided upwardly over the ramped surfaces 83R of the ramp elements 83 and allowed to accumulate on the support surface of the accumulator station AS. As mentioned earlier, the support surface is defined by the O-ring elements 72 of the lower transport element, i.e., the portion downstream of the vertical step 80, in combination with the side guides 82 of the accumulator 14. Upon reaching the accumulator station AS, the motion of each sheet 16 is halted by the nip rollers 84R, 86R of the second conveyance C2 which is inoperative while the sheets 16 are accumulated. That is, the nip spacing of the rollers 84R, 86R is sufficiently close to prevent any of the sheets 16 from passing downstream thereof. As the sheets are accumulated, a second Beginning of Collation/End of Collation mark, $N_2$TE is detected by the scanner 50 on a next collation sheet 16NC. Upon receipt of a next collation signal NCS, the processor 20 immediately identifies the location of the last sheet 16LS of the current collation, i.e., immediately downstream of the next collation sheet 16NC, by the first position sensor 52. In FIG. 6*b*, the last sheet 16LS of the current collation has already entered into the accumulator station AS inasmuch as the accumulator 14 has already accepted a portion of the next collation sheet 16NC. As a consequence, the trailing edge of the sheet 16LS has past the first threshold location L1 and a first position signal FPS has been issued by the first position sensor 52.

Figure 6C:
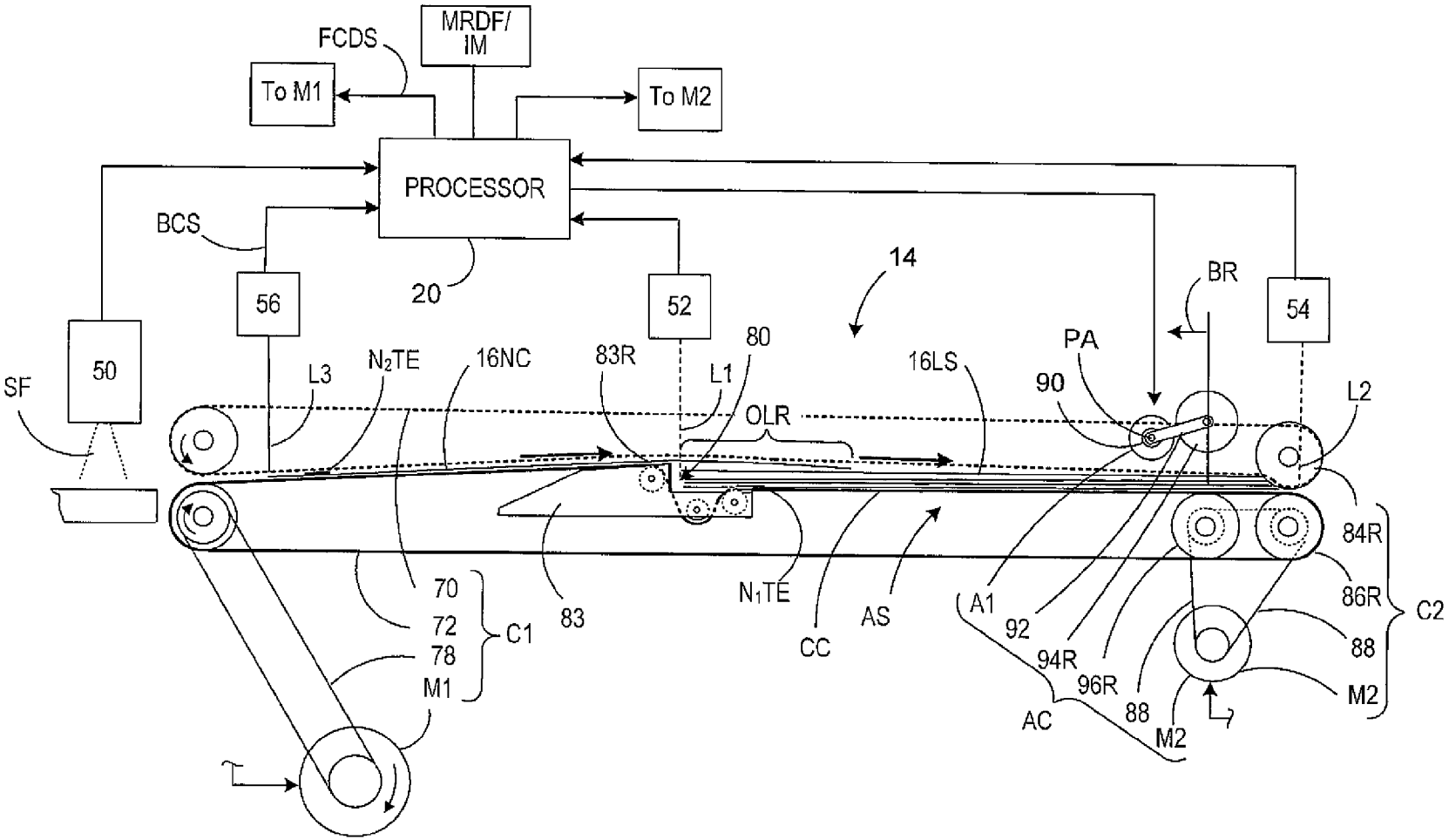

In FIG. 6*c*, the processor 20 continues to drive the motor M1 of the first conveyance C1, i.e., issues the first conveyance drive signal FCDS, until the next collation sheet 16NC has entered the buffer region BR of the accumulator 14. In the described embodiment, the buffer region BR may be broadly defined as a region of the conveyance feed path FP upstream of the auxiliary conveyance AC, indicated by the arrow BR. More specifically, the buffer region BR is a region wherein the next collation sheet 16NC is momentarily paused/stopped such that is its leading edge is upstream of the auxiliary conveyance rollers 94R, 96R and, accordingly, cannot be driven by the auxiliary conveyance until the current collation has be dispensed from the accumulator station AS. At the instant depicted in FIG. 6*c*, the processor 20 drives the first conveyance C1 such that at least a portion of the next collation sheet 16NC, i.e., the first sheet of the next collation, overlaps a portion OLR of the last sheet 16LS of the current collation CC. Moreover, the first conveyance C1 continues to drive until the next collation sheet 16NC has passed a third threshold location L3. In the described embodiment, the processor 20 is responsive to a third or buffer condition position signal BCS issued by the third position sensor 56 which indicates that the trailing edge of the next collation sheet 16NC has passed the third threshold location L3 along the conveyance feed path.

Stated in yet other terms, the first conveyance C1 continues to drive the first sheet of the next collation to effect a change in the spatial relationship between the first sheet of the next collation 16NC and the last sheet of the current collation 16LS next collation sheet. In the context used herein, the "change in spatial relationship" means that the first sheet of the next collation 16NC moves closer to the last sheet of the current collation. Additionally, the change in spatial relationship may result in a portion of the next collation sheet 16NC overlapping a portion of the last sheet of the current collation 16LS.

Figure 6D:
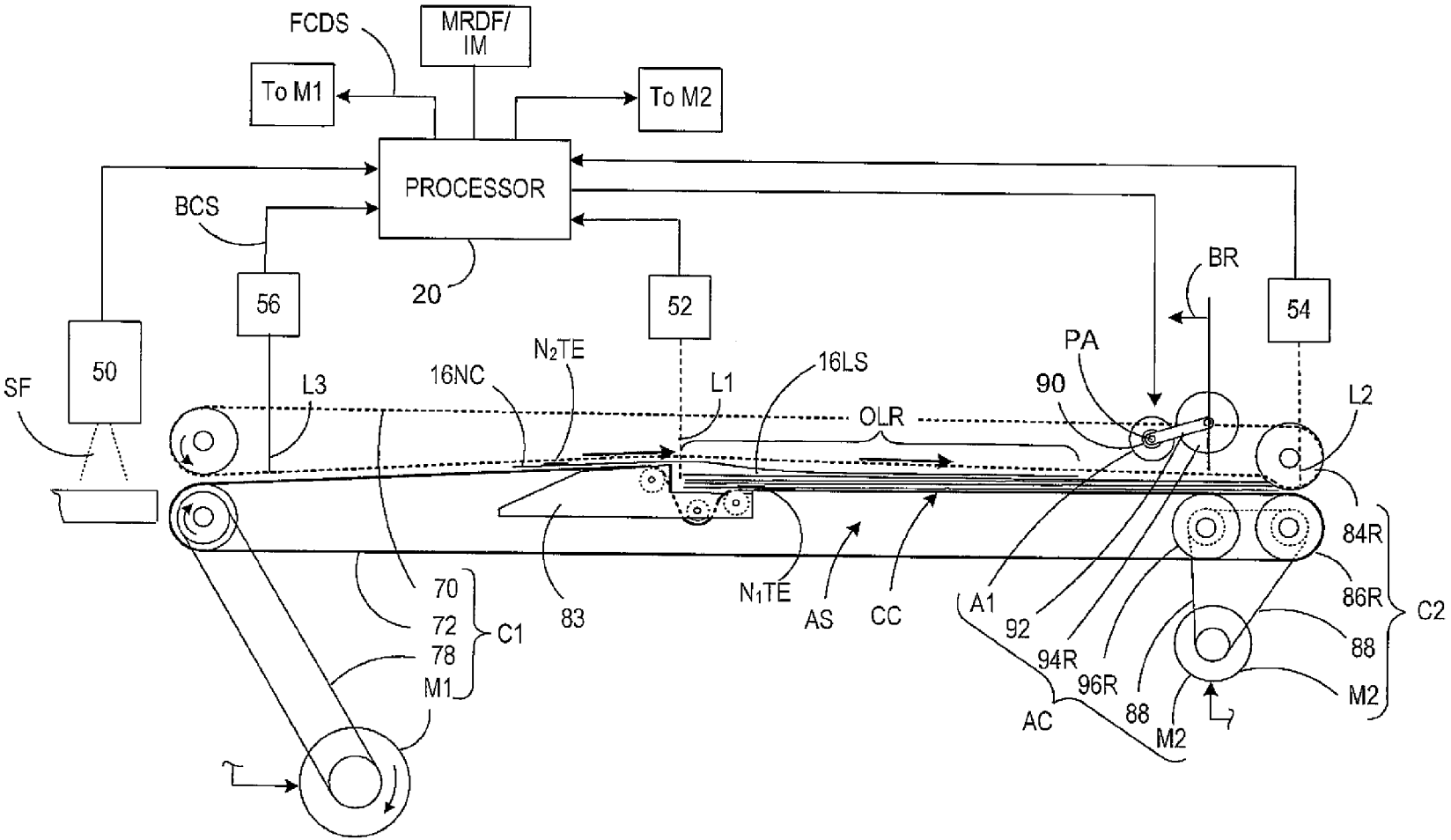

To better understand the potential length or breadth of the buffer region BR, FIG. 6*d* illustrates the degree of variation that may be anticipated or contemplated with respect to the buffer region BR. Therein, the first conveyance C1 is driven further downstream of the third threshold location L3. In this embodiment, the leading edge of the next collation sheet 16NC overlaps a greater portion OLR of the last sheet 16LS of the current collation CC. Hence, in this embodiment, the buffer condition signal BCS may be view as an indication that the next collation sheet 16NC has passed the third location L3 along the conveyance feed path FP, and reached a desired buffer station within the buffer region BR. The need to drive the next collation sheet 16NC further into the buffer region may be is embodiment may arise when larger sheets 16 are handled, i.e., seventeen inch (17") vs. eleven inch (11"), and the accumulator station AS is commensurately large to handle larger sheets.

In each of the embodiments illustrated in FIGS. 6*c* and 6*d*, the processor 20 is responsive to the buffer condition signal BCS signal TPS, and issues a first conveyance stop signal FCSS to the first conveyance C1, or changes the state of the drive signal FCDS, to momentarily stop the first conveyance C1. Whereas, in the first operating mode, the first conveyance C1 urges the completed collation CC into the second conveyance C2, in the second mode, the auxiliary conveyance AC is activated to feed the completed collation CC into the second conveyance C2.

Figure 6E:
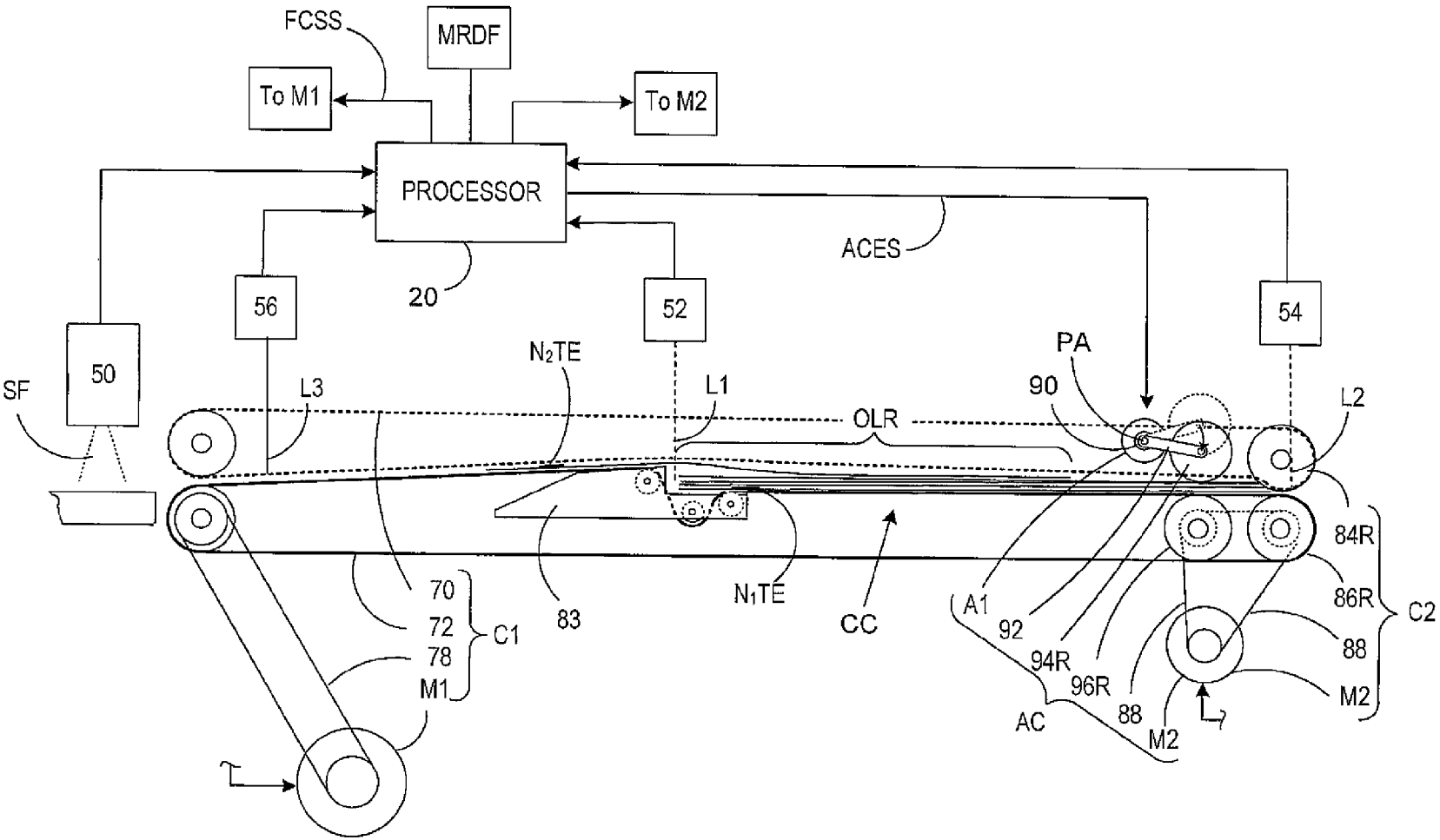

In FIG. 6*e*, the processor 20 is responsive to the buffer condition signal BCS, to inactive the first conveyance, actuate the rotary actuator A1 of the auxiliary conveyance AC, and activate the second conveyance C2. More specifically, the processor 20 issues first conveyance stop signal FCSS to discontinue/stop the motor M1 of the first conveyance C1. Furthermore, the processor 20 issues an auxiliary conveyance engage signal ACES to the rotary actuator A1 to rotate the arm 92 and idler roller 94R of the auxiliary conveyance AC from an inactive/disengaged position (shown in dashed lines) to an active or engaged position (shown in solid lines). As a result, the rotary actuator A1 produces a normal force between the idler and drive rollers 94R, 96R to increase the friction forces between the rollers 94R, 96R and/or between the sheets 16 of the completed collation CC.

Figure 6F:
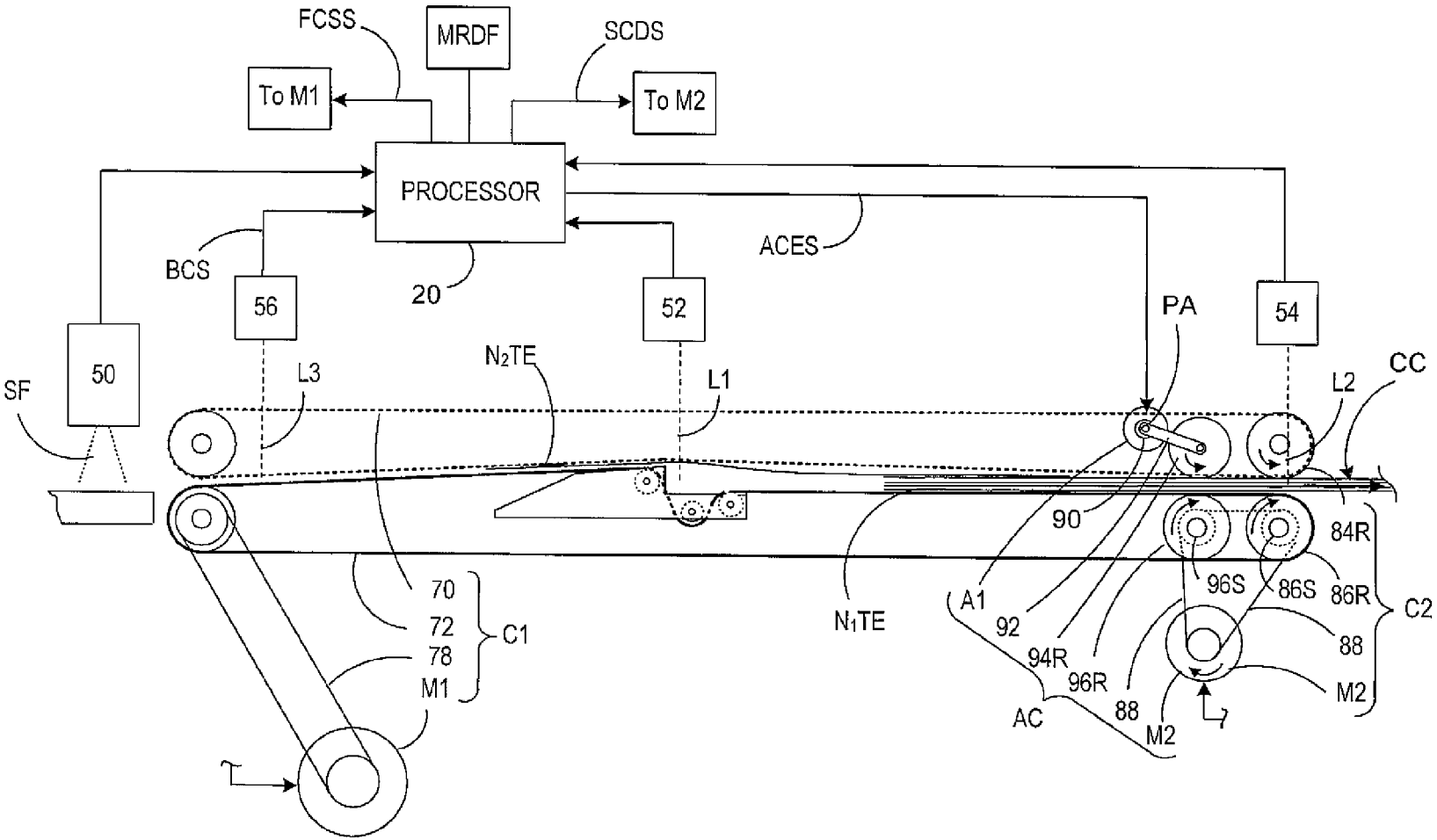

In FIG. 6*f*, the processor 20 is also responsive to the buffer condition signal BCS and issues a second conveyance drive signal SCDS to the motor M2 of the second conveyance C2. Inasmuch as the drive belt 88 circumscribes and drives the shafts 86S and 96S of the second and auxiliary conveyances, C2, AC, respectively, the auxiliary drive roller 96R is also driven to urge the completed collation into the second conveyance C2. Consequently, in the second operating mode, while the first conveyance C1 is momentarily inactive, the auxiliary conveyance AC functions in the same capacity as the first conveyance C1, i.e., to urge a completed conveyance into the nip rollers 94R, 96R of the second conveyance C2. Stated in yet other terms, in the second operating mode, the next collation sheet 16NC is captured by, and between the O-ring members 70, 72 of the first conveyance C1 while the complete collation CC is dispensed, or moved away, from the next collation sheet 16NC by the nip rollers 84R, 86R of the second conveyance C2. That is, the trailing edge portion of the next collation sheet 16NC is retained while the leading edge portion of the completed collation CC is conveyed by the auxiliary conveyance AC in combination with the secondary conveyance C2.

Figure 6G:
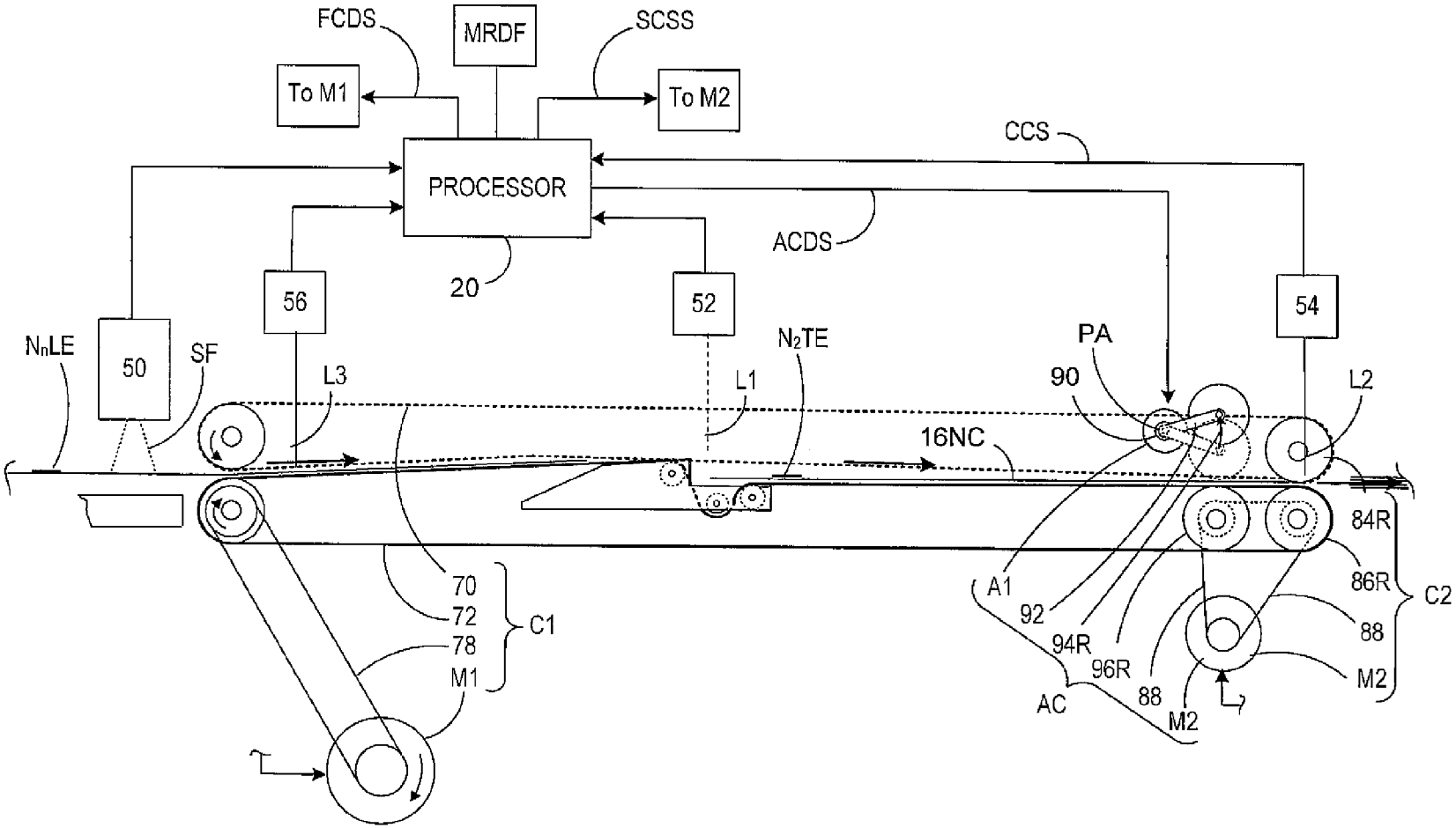

In FIG. 6*g*, the completed collation CC is dispensed from the accumulator station AS to a downstream module. More specifically, the processor 20 determines when the completed collation CC has passed the second threshold location L2 along the conveyance feed path FP. When the complete collation CC passes the sensed location L2, the second position sensor 54 issues a cycle completed signal CCS to the processor 20. In response thereto, the processor 20 disengages/disables the auxiliary and second conveyances AC, C2 and activates the first conveyance C1. More specifically, the processor 20: (i) issues a second conveyance stop signal SCSS to the motor M2 of the second conveyance C2 (which disables the drive to the drive roller 96R of the auxiliary conveyance AC, (ii) issues a disengage signal ACDS to the actuator A1 of the auxiliary conveyance AC (rotating the arm 92 and idler roller 94R in a counterclockwise direction away from the support deck of the accumulator station AS), and (iii) issues a first conveyance drive signal FCDS to the motor M1 of the first conveyance C1. By disabling the motor M2 of the second conveyance C2, the rollers 84R, 86R are stopped to retard the motion of the next collation sheet 16NC, thereby initiating another accumulation cycle.

As mentioned previously, the timing and coordination of various actions impacts the throughput of the feed input and accumulator modules 12, 14 and, consequently, the overall operation mailpiece inserter 10. While information from each of the position sensors 48, 52, 54, 56 can be used exclusively to operate/coordinate the modules 12, 14, in the described embodiment rotary encoders are used in combination with the sensors 48, 52, 54, 56, i.e., (disposed on at least one shaft rotational axis of each conveyance C1, C2, AC) to obtain additional, more accurate, sheet location information. Accordingly, the processor 20 uses both position sensors and rotary encoders to track the position of each sheet 16 and each collation CC.

The accumulator 14 is controlled to maximize throughput of the mailpiece inserter. In one embodiment of the invention, an operator provides the processor 20 information regarding the location of the BOC/EOC mark $N_n$, i.e., proximal to the leading or trailing edges. Based upon this information, the accumulator 14 operates in one of the first or second operating modes to accumulate the sheets 16 of a particular mail run job. Alternatively, information regarding the location of the BOC/EOC mark $N_n$ may be obtained from the mail run data file MRDF, i.e., an electronic file having information regarding the processing requirements of a job.

The accumulator is also adapted to maximize throughput by the independent control of the first and second conveyances C1, C2. For example, the accumulator module 14 may obtain data input from a downstream module, e.g., the chassis module (not shown), to timely dispense a completed collation or change the pitch distance PD, i.e., the spacing between the trailing edge of the sheets or between the trailing edge of a completed collation and a next collation sheet 16NC.

In summary, the vacuum roller assembly is adapted to reduce the audible noise levels produced by the passage of air through a plurality of slot-shaped apertures into a linear slot of the inner plenum. The slot-shaped apertures are off-axis with respect to the rotational axis to gradually introduce air into each aperture as each passes the underlying plenum slot. Furthermore, the slot-shaped apertures define a relatively shallow slope, i.e., less than ten (10) degrees relative to the rotational axis, to mitigate the loss of air through the apertures of the roller and linear slot of the inner plenum.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

What is claimed is:

1. A vacuum roller assembly for use in combination with a vacuum source, comprising:

a stationary inner plenum having a substantially linear plenum slot disposed in fluid communication with the vacuum source; and a rotating vacuum roller disposed over the stationary inner plenum and rotating about a rotational axis, the rotating vacuum roller having a plurality of apertures in fluid communication with the substantially linear plenum slot and disposed about the periphery in at least three regions of the rotating vacuum roller including a central region and an outboard region to each side of the central region, each of the apertures in only the outboard regions having a slot-shape defining a major axis, the major axis being off-axis with respect to the substantially linear plenum slot of the inner plenum and follows a helical path relative to the rotational axis.

2. The vacuum roller assembly according to claim 1 wherein the major axis of an aperture in one of the outboard regions slopes downwardly relative to the rotational axis and wherein the major axis of an aperture in the other of the outboard regions slopes upwardly relative to the rotational axis.

3. The vacuum roller assembly according to claim 1 wherein the major axis of an aperture in one of the outboard regions slopes downwardly relative to the rotational axis from one of the outboard edges of the vacuum roller to the central region and wherein the major axis of an aperture in the other of the outboard regions slopes upwardly relative to the rotational axis from the central region to the other of the outboard edges of the vacuum roller.

4. The vacuum roller assembly according to claim 1 wherein each of the slot-shaped apertures of the rotating vacuum roller defines an acute angle θ relative to the rotational axis.

5. The vacuum roller assembly according to claim 4 wherein the acute angle θ is between about five (5) degrees to about ten (10) degrees relative to the rotational axis.

6. The vacuum roller assembly according to claim 2 wherein each of the slot-shaped apertures of the rotating vacuum roller defines an acute angle θ relative to the rotational axis.

7. The vacuum roller assembly according to claim 6 wherein the acute angle θ is between about five (5) degrees to about ten (10) degrees relative to the rotational axis.

8. The vacuum roller assembly according to claim 1 wherein the apertures of the central region define a substantially circular shape and are arranged in a pattern of columns and helical rows.

9. The vacuum roller assembly according to claim 1 wherein the central region defines a concave surface about the circumference of the vacuum roller.

10. A singulating assembly for a feed module for singulating a sheet from a stack of sheets, comprising:

a vacuum source operative to develop a negative pressure relative to standard atmospheric pressure;

a vacuum roller assembly defining a rotational axis and including an inner plenum and a vacuum roller disposed over the inner plenum, the inner plenum having a substantially linear plenum slot in fluid communication with the vacuum source, the vacuum roller including a plurality of apertures in fluid communication with the substantially linear plenum slot such that a negative pressure may be developed along the surface of the vacuum roller through the plurality of apertures;

the apertures disposed about the periphery of the vacuum roller in at least three regions thereof, the three regions including a central region and an outboard region to each side of the central region; the central region defining a substantially concave curvature relative to a plane tangent to a longitudinal line along the surface of the vacuum roller; and a stationary finger having a convex guide surface complimenting with the concave curvature in the central region of the vacuum roller, wherein the convex guide surface of the stationary finger cooperates with the vacuum apertures and contour of the central region to augment the pressure differential across a sheet for reliably singulating sheets from the stack of only sheets, and wherein the apertures of the outboard regions are slot-shaped and each defines a major axis, the major axis of each being off-axis with respect to the substantially linear plenum slot of the inner plenum and following a helical path relative to the rotational axis.

11. The singulating apparatus according to claim 10 wherein each of the slot-shaped apertures of the rotating vacuum roller defines an acute angle θ relative to the rotational axis.

12. The singulating apparatus according to claim 11 wherein the acute angle θ is between about five (5) degrees to about ten (10) degrees relative to the rotational axis.

13. The singulating apparatus according to claim 11 wherein the apertures of the central region define a substantially circular shape and are arranged in a pattern of columns and helical rows.

* * * * *